US008761647B2

(12) United States Patent
Okano

(10) Patent No.: US 8,761,647 B2
(45) Date of Patent: Jun. 24, 2014

(54) IMAGE FORMING APPARATUS HAVING A CLEANING MODE CONTROL SECTION

(75) Inventor: Tetsuya Okano, Anjo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 223 days.

(21) Appl. No.: 13/274,740

(22) Filed: Oct. 17, 2011

(65) Prior Publication Data

US 2012/0106988 A1 May 3, 2012

(30) Foreign Application Priority Data

Oct. 29, 2010 (JP) ..... 2010-244398

(51) Int. Cl.
*G03G 15/20* (2006.01)

(52) U.S. Cl.
USPC ..... 399/327; 399/71

(58) Field of Classification Search
USPC ..... 399/9, 16, 21, 22, 71, 320, 327
See application file for complete search history.

(56) References Cited

U.S. PATENT DOCUMENTS

| | | | | |
|---|---|---|---|---|
| 7,711,302 | B2 | 5/2010 | Ueda | |
| 7,720,398 | B2 * | 5/2010 | Fukui | 399/34 |
| 2008/0095546 | A1 | 4/2008 | Abe | |
| 2009/0072468 | A1 | 3/2009 | Ueda | |

FOREIGN PATENT DOCUMENTS

| | | |
|---|---|---|
| CN | 101169605 A | 4/2008 |
| JP | H07-157141 | 6/1995 |
| JP | H07-215533 | 8/1995 |
| JP | 2004-45579 | 2/2004 |
| JP | 2004-170848 | 6/2004 |
| JP | 2006-65016 | 3/2006 |
| JP | 2006-154192 | 6/2006 |
| JP | 2007-065328 | 3/2007 |
| JP | 2008-185698 | 8/2008 |
| JP | 2009-265331 | 11/2009 |

OTHER PUBLICATIONS

Notice of Reasons for Rejection dated Jan. 17, 2013 received from the Japanese Patent Office from related Japanese Application No. 2010-244398, together with a partial English-language translation.

Chinese Office Action dated Jan. 6, 2014 from related Chinese Application No. 201110342559.9, together with an English language translation.

* cited by examiner

*Primary Examiner* — Hoan Tran
(74) *Attorney, Agent, or Firm* — Scully, Scott, Murphy & Presser, PC

(57) ABSTRACT

An image forming apparatus includes an image forming section which forms an image on a paper sheet by using a developer; a fixing section which includes a rotational axis and rotates around the rotational axis so as to fix the image formed on the paper sheet; a transport mechanism which transports the paper sheet on a paper transport route in a transport direction; a transport stop detecting section which detects a transport stop of the paper sheet; a judgment section which judges to which one of an upstream side and a downstream side of the fixing section in the transport direction the paper sheet is removed after the transport stop is detected by the transport stop detecting section; and a control section which controls the transport mechanism to execute a cleaning mode for cleaning the fixing section based on a judgment result of the judgment section.

21 Claims, 20 Drawing Sheets

Fig. 8

TIMING TABLE FOR JUDGING
REMOVAL DIRECTION OF PAPER

| | | PAPER FORWARD END POSITION | | | |
|---|---|---|---|---|---|
| | | UPSTREAM OF FIXING UNIT (A1) | UPSTREAM OF PAPER DISCHARGE SENSOR (A2) | DOWNSTREAM OF PAPER DISCHARGE SENSOR (A3) | DOWNSTREAM OF PAPER DISCHARGE ROLLERS (A4) |
| PAPER BACKWARD END POSITION | UPSTREAM OF DOWNSTREAM SENSOR (B1) | DOWNSTREAM SENSOR Off | DOWNSTREAM SENSOR Off | DOWNSTREAM / PAPER DISCHAGE SENSORS Off | DOWNSTREAM / PAPER DISCHAGE SENSORS Off |
| | UPSTREAM OF FIXING UNIT (B2) | UPSTREAM COVER Open | UPSTREAM / DOWNSTREAM COVERS Open | PAPER DISCHARGE SENSOR Off | PAPER DISCHARGE SENSOR Off |
| | DOWNSTREAM OF FIXING UNIT (B3) | | UPSTREAM / DOWNSTREAM COVERS Open | PAPER DISCHARGE SENSOR Off | PAPER DISCHARGE SENSOR Off |

Fig. 9A

TABLE FOR JUDGING REMOVAL DIRECTION OF PAPER

| UPSTREAM COVER Open<br>DOWNSTREAM COVER Open | | PAPER FORWARD END POSITION | | | |
|---|---|---|---|---|---|
| | | UPSTREAM OF FIXING UNIT (A1) | UPSTREAM OF PAPER DISCHARGE SENSOR (A2) | DOWNSTREAM OF PAPER DISCHARGE SENSOR (A3) | DOWNSTREAM OF PAPER DISCHARGE ROLLERS (A4) |
| PAPER BACKWARD END POSITION | UPSTREAM OF DOWNSTREAM SENSOR (B1) | UPSTREAM | UPSTREAM | DOWNSTREAM | DOWNSTREAM |
| | UPSTREAM OF FIXING UNIT (B2) | UPSTREAM | DOWNSTREAM | DOWNSTREAM | DOWNSTREAM |
| | DOWNSTREAM OF FIXING UNIT (B3) | | DOWNSTREAM | DOWNSTREAM | DOWNSTREAM |

Fig. 9B

TABLE FOR JUDGING REMOVAL DIRECTION OF PAPER

| UPSTREAM COVER Open DOWNSTREAM COVER Close | | PAPER FORWARD END POSITION | | | |
|---|---|---|---|---|---|
| | | UPSTREAM OF FIXING UNIT (A1) | UPSTREAM OF PAPER DISCHARGE SENSOR (A2) | DOWNSTREAM OF PAPER DISCHARGE SENSOR (A3) | DOWNSTREAM OF PAPER DISCHARGE ROLLERS (A4) |
| PAPER BACKWARD END POSITION | UPSTREAM OF DOWNSTREAM SENSOR (B1) | UPSTREAM | UPSTREAM | UPSTREAM | DOWNSTREAM |
| | UPSTREAM OF FIXING UNIT (B2) | UPSTREAM | UPSTREAM | UPSTREAM | DOWNSTREAM |
| | DOWNSTREAM OF FIXING UNIT (B3) | | UPSTREAM | UPSTREAM | DOWNSTREAM |

Fig. 9C

TABLE FOR JUDGING REMOVAL DIRECTION OF PAPER

| UPSTREAM COVER Close DOWNSTREAM COVER Open | | PAPER FORWARD END POSITION | | | |
|---|---|---|---|---|---|
| | | UPSTREAM OF FIXING UNIT (A1) | UPSTREAM OF PAPER DISCHARGE SENSOR (A2) | DOWNSTREAM OF PAPER DISCHARGE SENSOR (A3) | DOWNSTREAM OF PAPER DISCHARGE ROLLERS (A4) |
| PAPER BACKWARD END POSITION | UPSTREAM OF DOWNSTREAM SENSOR (B1) | UPSTREAM | DOWNSTREAM | DOWNSTREAM SENSOR Off: DOWNSTREAM/ PAPER DISCHARGE SENSOR Off: UPSTREAM | DOWNSTREAM SENSOR Off: DOWNSTREAM/ PAPER DISCHARGE SENSOR Off: UPSTREAM |
| | UPSTREAM OF FIXING UNIT (B2) | (UPSTREAM) | DOWNSTREAM | DOWNSTREAM | DOWNSTREAM |
| | DOWNSTREAM OF FIXING UNIT (B3) | | DOWNSTREAM | DOWNSTREAM | DOWNSTREAM |

Fig. 9D

TABLE FOR JUDGING REMOVAL DIRECTION OF PAPER

| UPSTREAM COVER Close<br>DOWNSTREAM COVER Close | | PAPER FORWARD END POSITION | | | |
|---|---|---|---|---|---|
| | | UPSTREAM OF FIXING UNIT (A1) | UPSTREAM OF PAPER DISCHARGE SENSOR (A2) | DOWNSTREAM OF PAPER DISCHARGE SENSOR (A3) | DOWNSTREAM OF PAPER DISCHARGE ROLLERS (A4) |
| PAPER BACKWARD END POSITION | UPSTREAM OF DOWNSTREAM SENSOR (B1) | UPSTREAM | UPSTREAM | UPSTREAM | DOWNSTREAM SENSOR Off: DOWNSTREAM/ PAPER DISCHARGE SENSOR Off: UPSTREAM |
| | UPSTREAM OF FIXING UNIT (B2) | (UPSTREAM) | (UPSTREAM) | (UPSTREAM) | DOWNSTREAM |
| | DOWNSTREAM OF FIXING UNIT (B3) | | (UPSTREAM) | (UPSTREAM) | DOWNSTREAM |

IMAGE FORMING APPARATUS HAVING A CLEANING MODE CONTROL SECTION

CROSS REFERENCE TO RELATED APPLICATION

The present application claims priority from Japanese Patent Application No. 2010-244398, filed on Oct. 29, 2010, the disclosure of which is incorporated herein by reference in its entirety.

BACKGROUND OF THE INVENTION

1. Field of the Invention

The present invention relates to an image forming apparatus, and in particular, to a technique relating to cleaning for a fixing section provided for the image forming apparatus.

2. Description of the Related Art

As a conventional technique relating to cleaning for a fixing section in an image forming apparatus, for example, Japanese Patent Application Laid-Open No. 2004-045579 discloses a technique as follows. That is, when a paper jam (fixing jam) occurs at the fixing section, a paper sheet is passed through the fixing section every time after the fixing jam is released by removing the jammed paper sheet by a user, so as to clean the fixing section.

According to the conventional technique described above, even if the image forming apparatus is not provided with an inherent cleaning mechanism for the fixing section, it is possible to prevent deterioration in image quality due to contamination of the fixing section, which is caused by the paper jam (fixing jam) at the fixing section, by utilizing a printing paper sheet as a cleaning paper sheet. However, the fixing section is not always contaminated when the paper jam occurs at the fixing section. Therefore, there is fear that time and paper sheets are wastefully consumed by cleaning the fixing section unnecessarily.

In view of the above, the present teaching discloses a technique which suppresses any waste when the fixing section is cleaned.

SUMMARY OF THE INVENTION

According to an embodiment of the present teaching, there is provided an image forming apparatus which forms an image on a paper sheet, including an image forming section which forms the image on the paper sheet by using a developer; a fixing section which includes a rotational axis and rotates around the rotational axis to fix the image formed on the paper sheet to the paper sheet; a transport mechanism which transports the paper sheet on a paper transport route in a predetermined transport direction; a transport stop detecting section which detects a transport stop of the paper sheet; a judgment section which judges to which one of an upstream side and a downstream side of the fixing section in the transport direction the paper sheet is removed after the transport stop is detected by the transport stop detecting section; and a control section which controls the transport mechanism to execute a cleaning mode for cleaning the fixing section, and which determines whether or not the cleaning mode is to be executed based on a judgment result of the judgment section.

According to the image forming apparatus of the present teaching, the control section judges whether or not the cleaning mode is to be executed based on the judgment result of the judgment section. Accordingly, as compared with a case in which the cleaning for the fixing section is performed every time after the fixing jam occurs, it is possible to suppress a waste of time and paper sheets, which would be otherwise caused by the cleaning for the fixing section.

BRIEF DESCRIPTION OF THE DRAWINGS

FIG. 8 is a table showing conditions for judging the removal direction of the paper sheet.

FIGS. 9A to 9D are tables used for judging the removal direction of the paper sheet.

DESCRIPTION OF THE PREFERRED EMBODIMENTS

Figure 1:
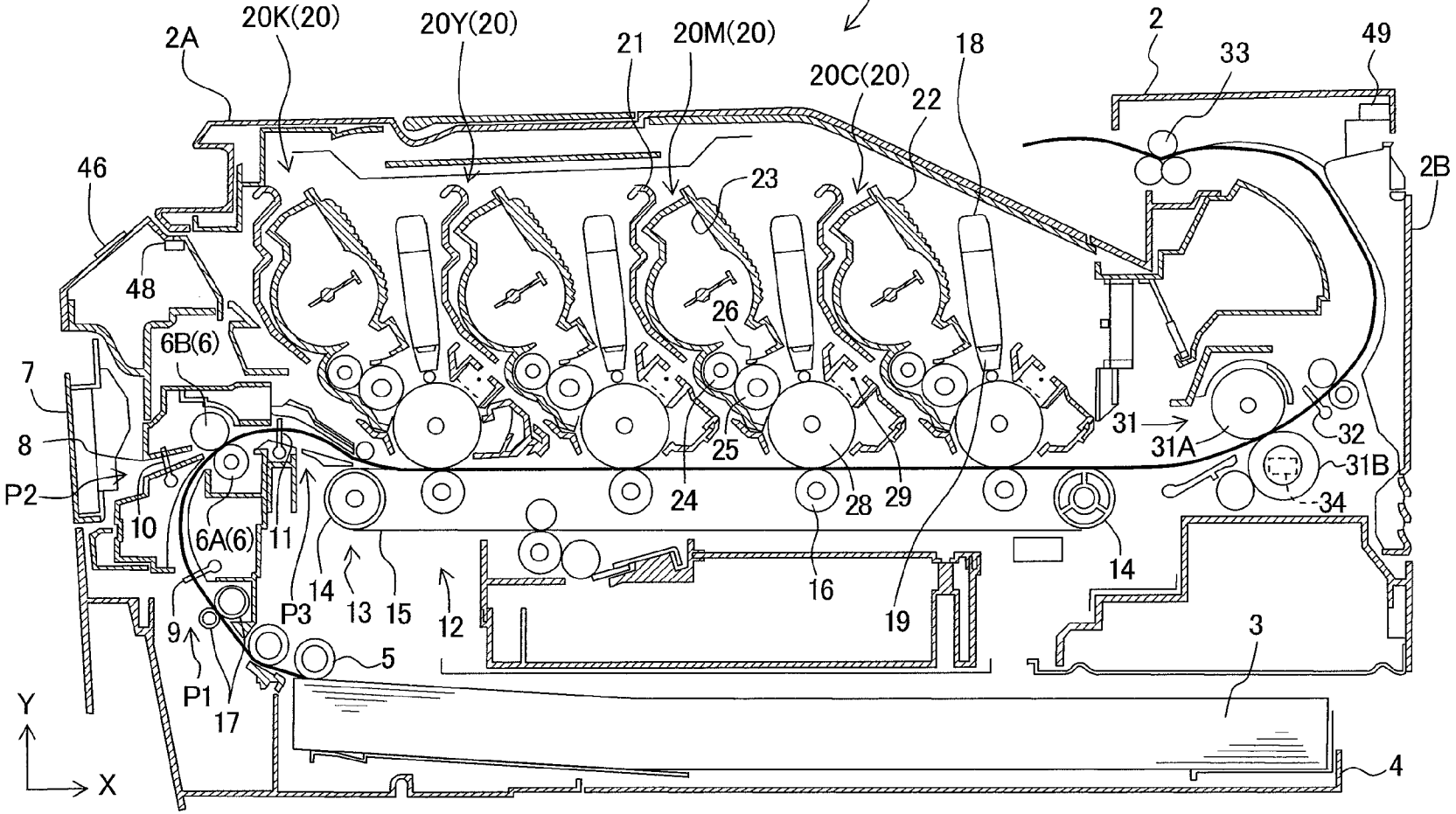
FIG. 1 is a side sectional view of a schematic structure of a printer according to the present invention.

Next, an explanation will be made about an embodiment of the present invention with reference to FIG. 1 to FIG. 12. At first, an overall construction of a printer will be explained with reference to FIG. 1. A printer 1 is a color LED printer of a direct tandem type which forms a color image by using four color toners (black K, yellow Y, magenta M, cyan C). In the following description, a left side of a horizontal direction (X axis direction) in FIG. 1 is let to be a frontward direction. Further, reference numerals will be appropriately omitted in constitutive parts or components, which are used commonly to each of the colors. The image forming apparatus is not limited to the color LED printer of the direct tandem type, and may be, for example, a color laser printer, a monochrome or black and white laser printer, or a multifunction machine having copy function etc.

The printer 1 includes a casing 2 and a paper feeding tray 4 on which a plurality of paper sheets 3 can be placed and which is disposed on the bottom portion of the casing 2, which is arranged below in the vertical direction (Y axis direction) in FIG. 1.

Paper feeding rollers 5 are arranged over or above the front end of the paper feeding tray 4. The paper sheet 3 positioned uppermost in the paper feeding tray 4 is fed to a supply route P1 arranged in the front portion of the casing 2 by rotation of the paper feeding rollers 5.

The supply route P1 is provided with an auxiliary paper feeding rollers 17 and resist rollers 6 including a driving roller 6A and a driven roller 6B. The driving roller 6A is connected, via a gear mechanism (not shown) or the like, to a paper feeding motor 47. A driving force of the paper feeding motor 47 is transmitted to the driving roller 6A.

The manual feeding guide 7, which is tiltable forward, is provided for a front surface of the casing 2. A manual feeding opening 8, into which the user is capable of inserting the paper sheet 3, is opened inside the manual feeding guide 7. The manual feeding opening 8 is communicated with the resist rollers 6 via a manual feeding route P2. Further, a transporting route P3, which is communicated with the belt unit 13 of an image forming section 12, is formed at a rear side of the resist rollers 6.

The resist rollers 6 are capable of transporting the paper sheet 3, which is fed from the supply route P1 or the manual feeding route P2, onto the belt unit 13 of the image forming section 12 via the transporting route P3. Further, an upstream sensor 9 arranged at an upstream side of the resist rollers 6 in the paper transport direction, a manual feeding sensor 10 arranged at an upstream side of the resist rollers 6 in a paper transport direction, and a downstream sensor 11 arranged at a downstream side of the resist rollers 6 in the paper transport direction are provided on the supply route P1, the manual feeding route P2, and the transporting route P3, respectively. The sensors 9, 10, 11 detect a presence or absence of the paper sheet 3 at respective positions. Note that the "paper transport direction" is a direction in which the paper sheets 3 provided from the paper feeding tray 4 or the manual feeding guide 7 are transported in the casing 2.

The image forming section 12 includes the belt unit 13, exposure sections 18, process sections 20, and the fixing unit 31, etc. The belt unit 13 includes an annular belt 15 suspended between a pair of front and rear belt support rollers 14. The belt support roller 14 disposed at the rear side is rotationally driven to move the annular belt 15 in a circulating manner in the clockwise direction as shown in FIG. 1, thereby transporting rearward the paper sheet 3 carried on the annular belt 15. Four transfer rollers 16 are provided inside the annular belt 15.

Four exposure sections 18 and the process sections 20 are provided over or above the belt unit 13. The exposure sections 18 include LED units corresponding to the colors of black, yellow, magenta, cyan, respectively. The exposure sections 18 have LED heads 19 at lower end portions thereof, respectively. Light emitted from each of the exposure sections 18 is controlled based on image data to be formed and is irradiated from each of the LED heads 19 to a surface of one of the photosensitive drums 28.

The process sections 20 include the four process cartridges 20K, 20Y, 20M, 20C corresponding to the aforementioned black, yellow, magenta, cyan, respectively. Each of the process cartridges 20*k*, 20Y, 20M, 20C includes a cartridge flame 21 and a developing cartridge 22 removably installed to the cartridge flame 21. The developing cartridge 22 includes a toner container 23 containing a toner (developer) of one of the colors, and includes a supply roller 24, a developing roller 25, a layer thickness-regulating blade 26, etc., below the toner container 23.

The toner released from the toner container 23 is supplied to the developing roller 25 in accordance with the rotation of the supply roller 24, and then the toner is frictionally charged or subjected to the frictional electrification positively between the supply roller 24 and the developing roller 25. Further, the toner supplied onto the developing roller 25 enters between the layer thickness-regulating blade 26 and the developing roller 25 in accordance with the rotation of the developing roller 25. The toner is sufficiently subjected to the frictional electrification between the layer thickness-regulating blade 26 and the developing roller 25, and is carried on the developing roller 25 as a thin film having a constant thickness.

The photosensitive drum 28 having a surface covered with a photosensitive layer of positive charging characteristic and a charger 29 are provided at a lower side of each of the cartridge flames 21. A nip section is fanned between the photosensitive drum 28 and one of the transfer rollers 16 via the annular belt 15. The surface of the photosensitive drum 28 is uniformly charged positively by the charger 29 during the image formation, and the surface which is charged positively is exposed by the exposure section 18. Accordingly, an electrostatic latent image is formed on the surface of the photosensitive drum 28.

Subsequently, the toner, which is carried on the developing roller 25 and is charged positively, is supplied to the electrostatic latent image formed on the surface of the photosensitive drum 28. By doing so, the electrostatic latent image is converted into a visual image. Thereafter, a toner image carried on the surface of each of the photosensitive drums 28 is successively transferred onto the paper sheet 3 by a negative transfer voltage, which is applied to each of the transfer rollers 16 while the paper sheet 3 passes through each of the nip sections between one of the photosensitive drums 28 and one of the transfer rollers 16.

The paper sheet 3 having the toner image transferred thereto is then transported to the fixing unit 31 (an example of the fixing section) by the belt unit 13. The fixing unit 31 includes a heat source, a heating roller 31A which has a rotational axis (not shown) extending in a direction perpendicular to the paper transport direction, and a pressurizing roller 31B which has the rotational axis (not shown) extending in the direction perpendicular to the paper transport direction and presses the paper sheet 3 toward the heating roller 31A. The surface of the paper sheet 3 on which the image has been formed is pressed to the heating roller 31A while the paper sheet 3 passes through the fixing unit 31, and the transferred toner image is thermally fixed onto the surface of the paper sheet 3. The paper sheet 3, on which the toner image has been thermally fixed by the fixing unit 31, is transported upward and then discharged on an upper surface of the casing 2 by the paper discharge rollers 33. As described above, in this embodiment, the paper sheet 3 is transported on a paper transport route from the paper feeding tray 4 or the manual feeding guide 7 to the upper surface of the casing 2 in the paper transport direction via the paper feeding rollers 5, the auxiliary paper feeding rollers 17, the resist rollers 6, the belt unit 3, the fixing unit 31, the paper discharge rollers 33, and the like. The casing 2 includes an upper cover 2A (an example of an upstream cover) and a rear cover 2B (an example of a downstream cover) each of which is configured to open and close. An upper cover sensor 48 (an example of an upstream cover detecting section and a transport stop detecting section) which detects opening/closing of the upper cover 2A is provided near the upper cover 2A of the casing 2, and a rear cover sensor 49 (an example of a downstream cover detecting section and the transport stop detecting section) which detects opening/closing of the rear cover 2B is provided near the rear cover 2B of the casing 2. When the upper cover 2A is opened, it is possible to access the process cartridges 20K, 20Y, 20M, 20C and the belt unit 13, and to access the fixing unit (fuser) 31 from an upstream side in the paper transport direction. Namely, the fixing unit 31 and a part of the paper transport route on the upstream side of the fixing unit 31 in the paper transport direction are accessible for the user by opening the upper cover 2A. On the other hand, when the rear cover 2B is opened, it is possible to access paper discharge rollers 33 and to access the fixing unit 31 from a downstream side in the paper transport direction. Namely, the fixing unit 31 and another part of the paper transport route on the downstream side of the fixing unit 31 in the transport direction are accessible for the user by opening the rear cover 2B.

The printer 1 includes an image forming mode in which the toner image on the photosensitive drum 28 is transferred onto the paper sheet 3 and a cleaning mode in which any adhesion on the fixing unit 31, such as the toner, is removed by a cleaning sheet. In the cleaning mode, the cleaning sheet is supplied, instead of the paper sheet 3, from the paper feeding tray 4 or the manual feeding opening 8. For example, in a case that a cleaning sheet 50 is placed on the paper feeding tray 4 and supplied therefrom, the cleaning sheet 50 is transported to the position, at which the fixing unit 31 is placed, by transport mechanisms such as the paper feeding rollers 5, the auxiliary paper feeding rollers 17, the resist rollers 6, the belt unit 13. The adhesion (toner) on the fixing unit 31 is removed by adhering the adhesion to the cleaning sheet. The paper sheet 3 for printing may be used as the cleaning sheet. In this embodiment, an example in which the paper sheet 3 for printing is used as the cleaning sheet is described.

Figure 2:
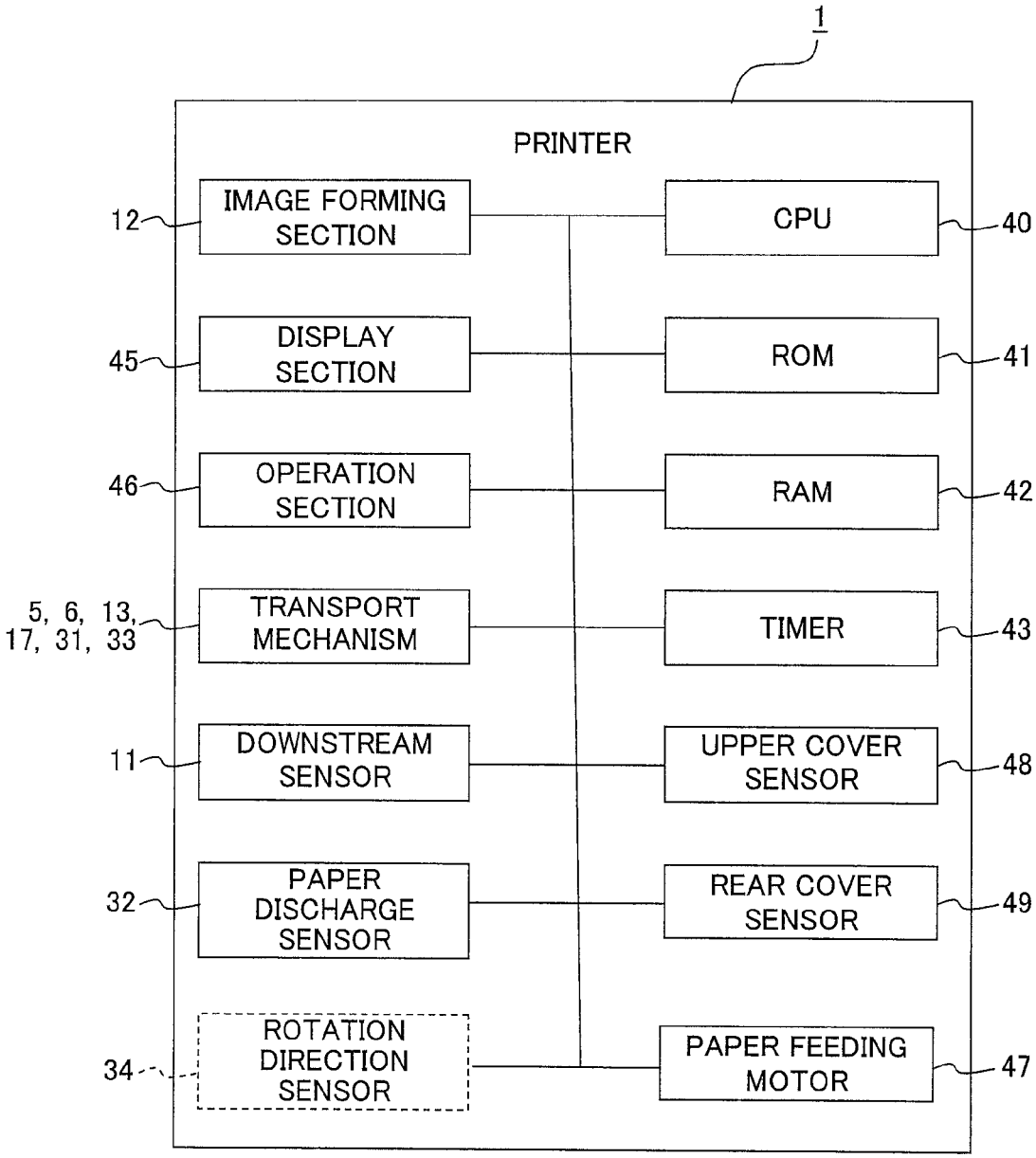
FIG. 2 is a block diagram schematically showing an electrical structure of the printer.

Next, an electrical construction of the printer 1 will be described with reference to FIG. 2. As shown in FIG. 2, the printer 1 includes a CPU 40 (an example of a judgment section, a control section, a calculating section), a ROM 41, a RAM 42, and a NVRAM (non-volatile memory). These components are connected with, for example, the image forming section 12, the downstream sensor 11 (an example of a paper detecting section, a first paper detecting section, and the transport stop detecting section), a paper discharge sensor 32 (an example of the paper detecting section, a second paper detecting section, and the transport stop detecting section), a timer 43 (an example of the transport stop detecting section), a display section 45 (an example of a reporting section), an operation section 46, a paper feeding motor 47, and a transport mechanism including the paper feeding rollers 5, the auxiliary paper feeding rollers 17, the resist rollers 6, the belt unit 13, the fixing unit 31, the paper discharge rollers 33, etc.

The display section 45 includes a liquid crystal display, a lamp, etc. and displays various setting screens, operation states of the apparatus, various warnings, etc. The operation section 46 includes a plurality of buttons, and the user performs various input operations through the operation section 46. For example, when the CPU 40 prompts the user execution of the cleaning mode for cleaning the fixing unit 31 via the display panel 45, the user finally inputs a selection as to whether or not to execute the cleaning mode through the operation section 46. By doing so, it is possible to compensate an erroneous judgment of the CPU 40, thereby improving convenience of the printer 1.

In the ROM 41, various programs, tables, etc., for executing the operation of the printer 1 are stored. The operation of the printer 1 includes, for example, a cleaning process as described later on. The CPU 40 controls each of the sections, while storing, in the RAM 42, a processing result in accordance with the program read from the ROM 41.

The CPU 40 performs a switching operation between the image forming mode and the cleaning mode, for example, in accordance with an instruction by the user through the operation section 46. When the image forming mode is selected, the CPU 40 controls the image forming section 12 so that the toner image on the photosensitive drum 28 is transferred on the paper sheet 3 to form the image on the paper sheet 3.

On the other hand, when the cleaning mode is selected, the CPU 40 controls the execution of the cleaning operation for the photosensitive drum 28 or the fixing unit 31. In particular, when the execution of the cleaning mode for the fixing unit 31 is controlled, and when transportation of the paper sheet 3 having the image formed thereon by the transport mechanism is stopped due to an error, the CPU 40 displays the warning relating to the error on the display section 45 or the like. Then, the CPU 40 judges to which one of the upstream side and the downstream side in the paper transport direction the paper sheet 3 is removed (pulled) by the user, after the transportation of the paper sheet 3 is stopped due to the error.

Upon this judgment, the CPU 40 judges as to whether or not the paper sheet 3, the transportation of which is stopped, is passing through the fixing unit 31, based on a detection result of the downstream sensor 11 or the paper discharge sensor 32 and a measurement time by the timer 43. When it is judged that the paper sheet 3 is passing through the fixing unit 31, the CPU 40 judges to which one of the upstream side and the downstream side of the fixing unit 31 in the paper transport direction the paper sheet 3 is removed. When it is judged that the paper sheet 3 is not passing through the fixing unit 31, the CPU 40 cancels the warning relating to the transport stop without prompting the execution of the cleaning mode.

Here, the "error" is defined such that the transportation of the paper sheet 3 by the transport mechanism is stopped. For example, the error may include a paper jam of the paper sheet 3 at the fixing unit 31 or any other position. For example, in a case that the detection result of the paper discharge sensor 32 does not change for a predetermined time period, the transport stop of the paper sheet 3 may be detected as a paper jam. Further, the error is not limited to the paper jam of the paper sheet 3 and may include indirect errors which do not directly cause the transport stop of the paper sheet 3 but by which the transportation of the paper sheet 3 can not be continued, such as a motor error of the paper feeding motor 47, an opening of the upper cover 2A, an opening of the rear cover 2B, and the like. It is allowable that the CPU 40 judges to which one of the upstream side and the downstream side of the fixing unit 31 in the paper transport direction the paper sheet 3 is removed, even when the transportation of the paper sheet 3 is stopped due to the error other than the paper jam of the paper sheet 3 at the fixing unit 31. In that case, it is possible to reduce any waste which would be otherwise caused by the cleaning for the fixing unit 31.

An example is described in which the judgment section, the control section, and the calculating section are configured by the CPU 40, but the present teaching is not limited thereto. For example, the judgment section, the control section, and the calculating section may be configured by individual circuits or an ASIC (Application Specific Integrated Circuit).

Subsequently, an explanation will be made in detail about a cleaning process for the fixing unit in this embodiment with reference to FIG. 3A to FIG. 11. At first, a "basic flow of the cleaning for the fixing unit" will be explained with reference to FIGS. 3A and 3B.

For example, when the cleaning mode for the fixing unit is selected by the user through the operation section 46, the CPU 40 starts the cleaning process for the fixing unit 31 in accordance with a predetermined program.

Figure 3A:
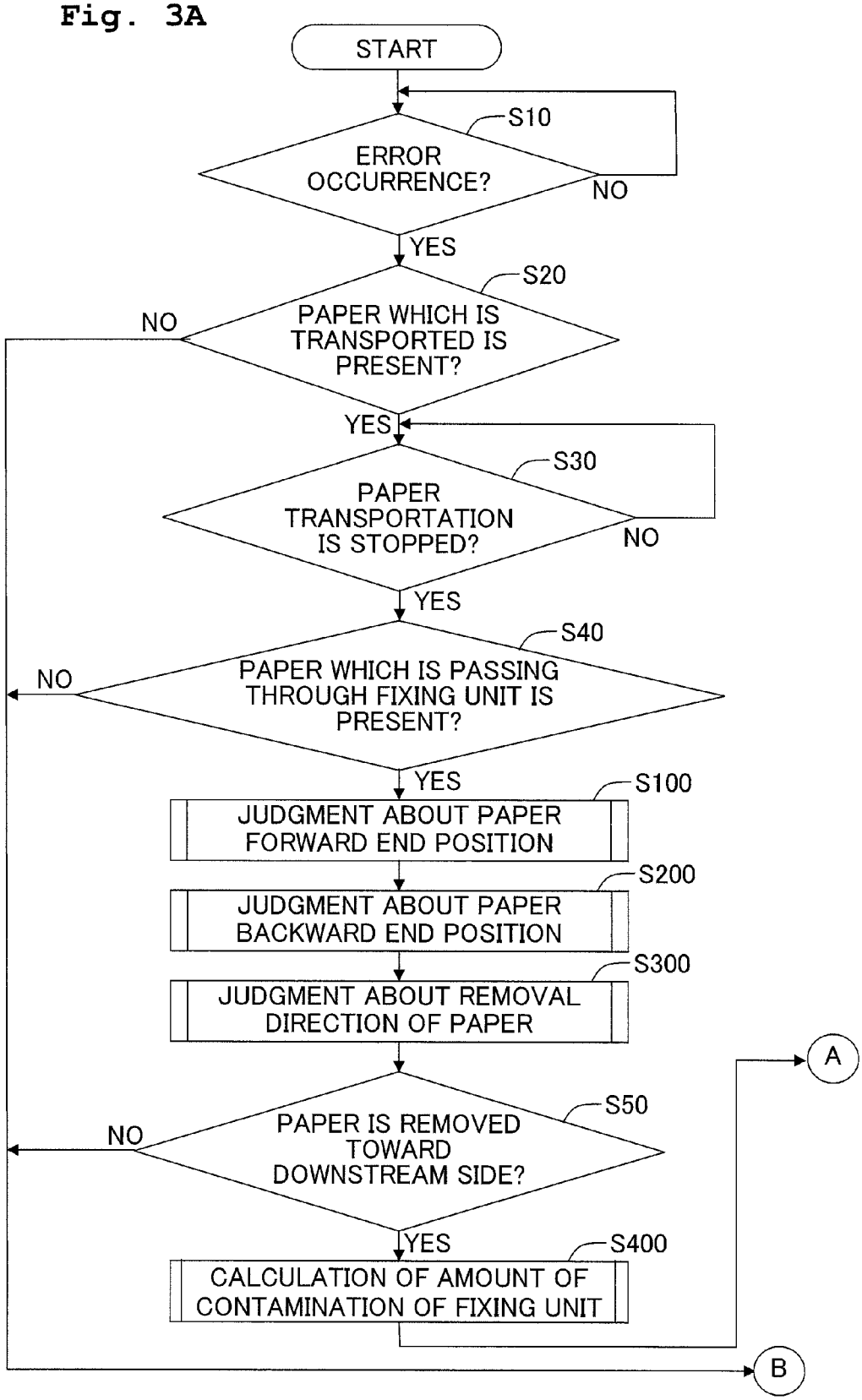
FIGS. 3A and 3B are a flowchart showing a basic flow of a cleaning for a fixing section.
Figure 3B:
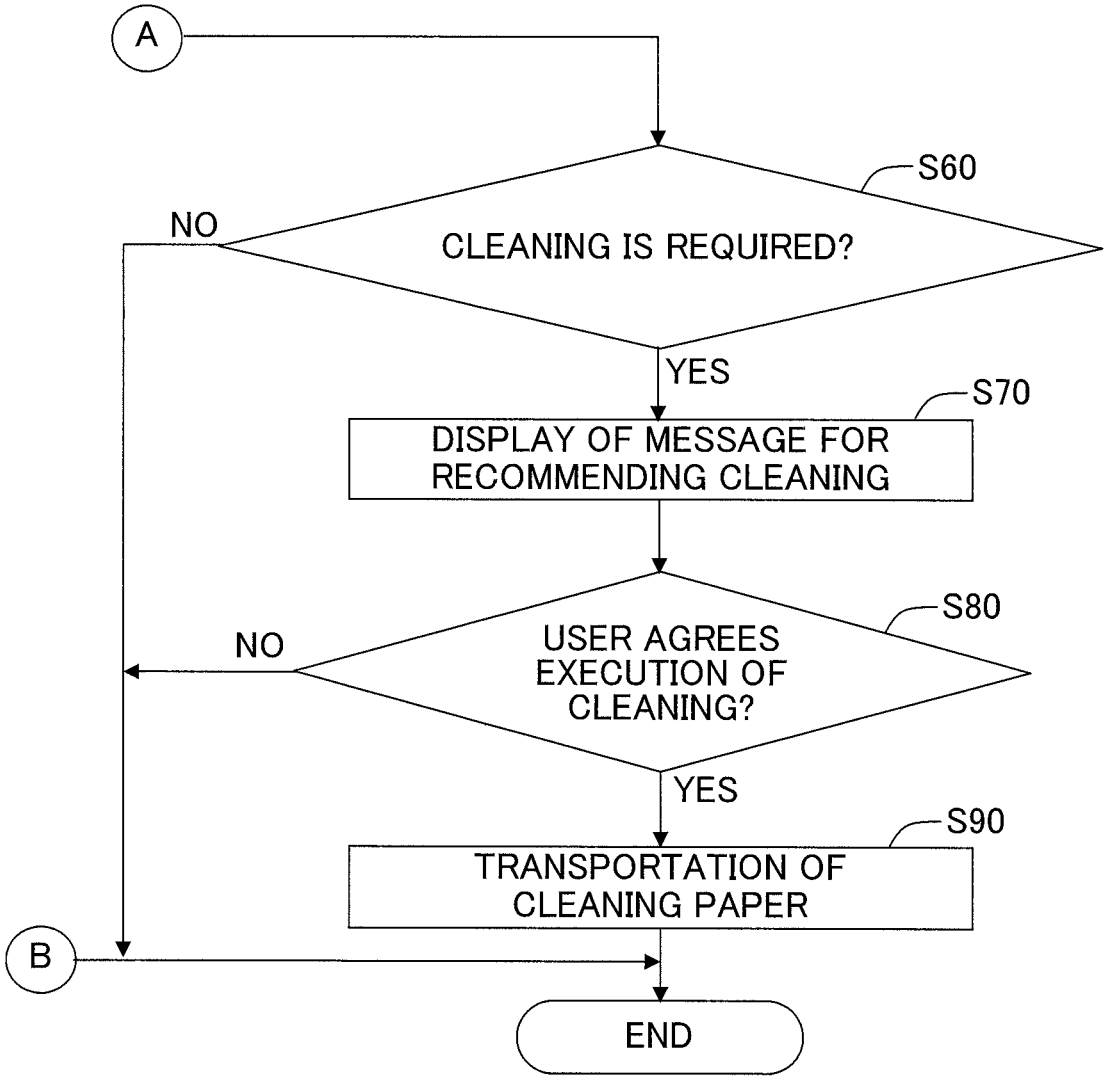

At first, the CPU 40 judges, at a step S10 in FIG. 3A, as to whether or not the error, such as the paper jam of the paper sheet 3, occurs in the printer 1. When the error occurs (step S10: Yes), the CPU 40 displays the warning corresponding to the occurred error on the display section 45 or the like, and judges whether the paper sheet 3, which is transported at the time of occurrence of the error, is present or not (step S20). It is noted that the judgment as to whether the paper sheet 3, which is transported at the time of the occurrence of the error, is present or not is performed based on, for example, a feeding operation of the paper sheet 3, a detection state of at least one or more paper sensors disposed at transporting route, and time elapsed after the detection state of each of the sensors changed.

When the paper sheet 3, which is transported at the time of the occurrence of the error, is not present (step S20: NO), the cleaning process is completed because there is no fear that the fixing unit 31 is contaminated and thus there is no need to perform the cleaning. On the other hand, when the paper sheet 3, which is transported at the time of the occurrence of the error, is present (step S20: YES), the CPU 40 judges whether the transportation of the paper sheet 3 is stopped (step S30). The judgment as to whether the transportation of the paper sheet 3 is stopped is performed, for example, by detecting a rotation state of a paper transporting motor.

Figure 4:
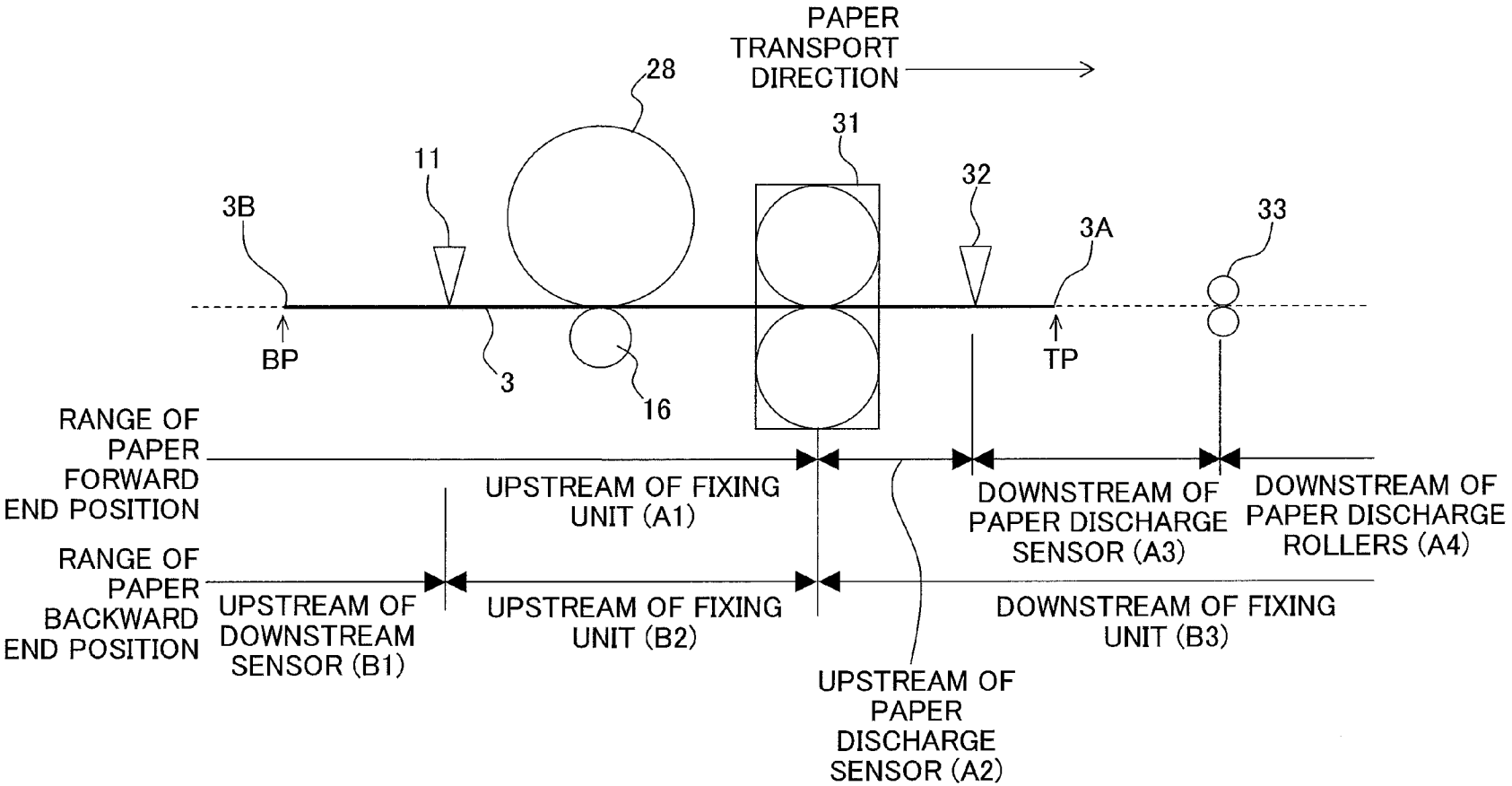
FIG. 4 is an illustrative view illustrating a position of a paper sheet.

When it is judged that the transportation of the paper sheet 3 is stopped (step S30: YES), the CPU 40 judges whether the paper sheet 3, which is passing through the fixing unit 31, is present or not (step S40). When the paper sheet 3, which is passing through the fixing unit 31, is not present (step S40: NO), the cleaning process is completed. This is because the fixing unit 31 is not contaminated by the paper sheet 3 on which the transferred toner image is not yet fixed. Therefore, there is no need to perform the cleaning for the fixing unit 31. Here, it is assumed that the passage of the paper sheet 3 through the fixing unit 31 is completed when the paper discharge sensor 32 switches to an OFF state by detecting a backward end 3B of the paper sheet (paper backward end 3B). FIG. 4 shows a state in which the passage of the paper sheet 3 through the fixing unit 31 is uncompleted. Further, for example, the measurement time, which is measured by the timer 43, from when a forward end 3A of the paper sheet (paper forward end 3A) (see FIG. 4) is detected by the downstream sensor 11, is utilized for judging whether or not the paper sheet 3 is passing through the fixing unit 31.

On the other hand, when the paper sheet 3, which is passing through the fixing unit 31, is present (step S40: YES), a "routine for judging a paper forward end position" (step S100), a "routine for judging a paper backward end position" (step S200), and a "routine for judging a removal direction of a paper sheet" (step S300), as described later on, are performed.

Subsequently, the CPU 40 judges, at a step S50, whether the paper sheet 3 is removed (pulled) toward the downstream side of the fixing unit 31 in the paper transport direction, based on a result of the "routine for judging the removal direction of the paper sheet".

When it is judged that the paper sheet 3 is not removed toward the downstream side of the fixing unit 31 in the paper transport direction (step S50: NO), that is, when it is judged that the paper sheet 3 is removed toward the upstream side of the fixing unit 31 in the paper transport direction, the CPU 40 judges that the cleaning for the fixing unit 31 is not required and completes the cleaning process. This is because the fixing unit 31 is not contaminated by the paper sheet 3 on which the transferred toner image is not yet fixed. When the cleaning process is completed, the CPU 40 does not prompt the execution of the cleaning mode for cleaning the fixing unit 31. Further, when the error is the paper jam of the paper sheet 3, the warning relating to the error is canceled.

On the other hand, when it is judged that the paper sheet 3 is removed toward the downstream side of the fixing unit 31 in the paper transport direction (step S50: YES), a "routine for calculating an amount of contamination of the fixing unit" (step S400), as will be described later on, is performed. Then, the CPU 40 judges, at step S60, whether or not the cleaning for the fixing unit 31 is required, based on a result of the "routine for calculating the amount of contamination of the fixing unit".

When it is judged that the cleaning for the fixing unit 31 is not required (step S60: NO), the cleaning process is completed. When the cleaning process is completed, the CPU 40 does not prompt the execution of the cleaning mode for cleaning the fixing unit 31. Further, when the error is the paper jam of the paper sheet 3, the warning relating to the error is canceled.

On the other hand, when it is judged that the cleaning for the fixing unit 31 is required (step S60: YES), the CPU 40 displays, for example, a message for recommending the cleaning on the display section 45. That is, the CPU 40 prompts the execution of the cleaning mode.

Then, the CPU 40 judges whether or not the user agrees the execution of the cleaning mode for the fixing unit 31 (step S80). That is, it is judged whether or not the user selects the execution of the cleaning for the fixing unit 31, for example, through the operation section 46. When the user does not agree the execution of the cleaning (step S80: NO), the cleaning process is completed.

On the other hand, when the user agrees the execution of the cleaning (step S80: YES), the cleaning for the fixing unit 31 is executed by transporting the cleaning sheet, that is, the paper sheet 3 for printing.

When it is judged at the step S50 that the paper sheet 3 is removed toward the downstream side of the fixing unit 31 in the paper transport direction, the CPU may prompt the execution of the cleaning mode without performing the "routine for calculating the amount of contamination of the fixing unit" at the step S400. By doing so, it is possible to suppress the waste of the time at the time of performing the cleaning for the fixing unit 31, because the fixing unit 31 is likely to be contaminated when the paper sheet 3 is removed (pulled) toward the downstream side of the fixing unit 31 in the paper transport direction.

Figure 5A:
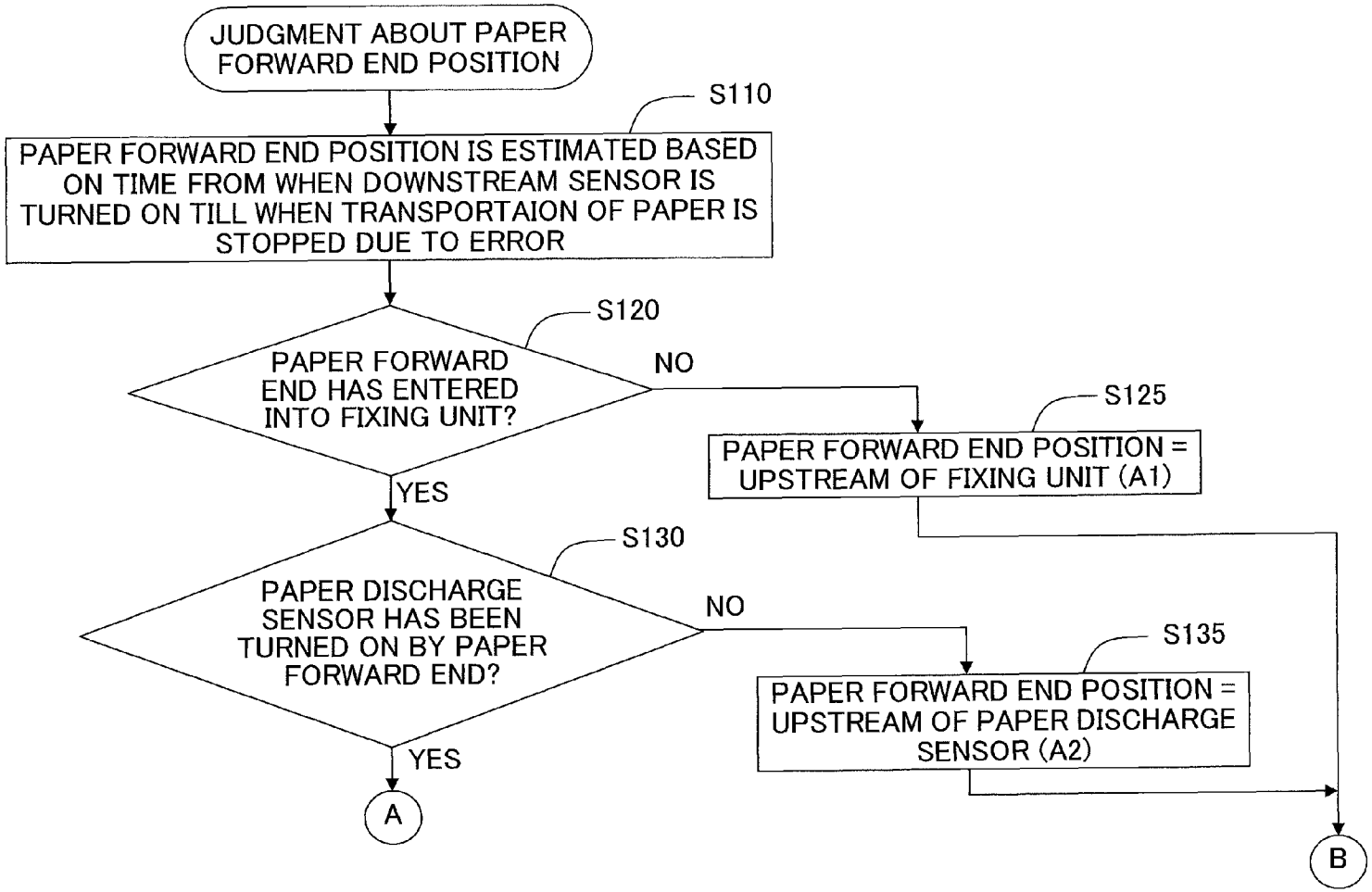
FIGS. 5A and 5B are a flowchart showing a routine for judging a paper forward end position.
Figure 5B:
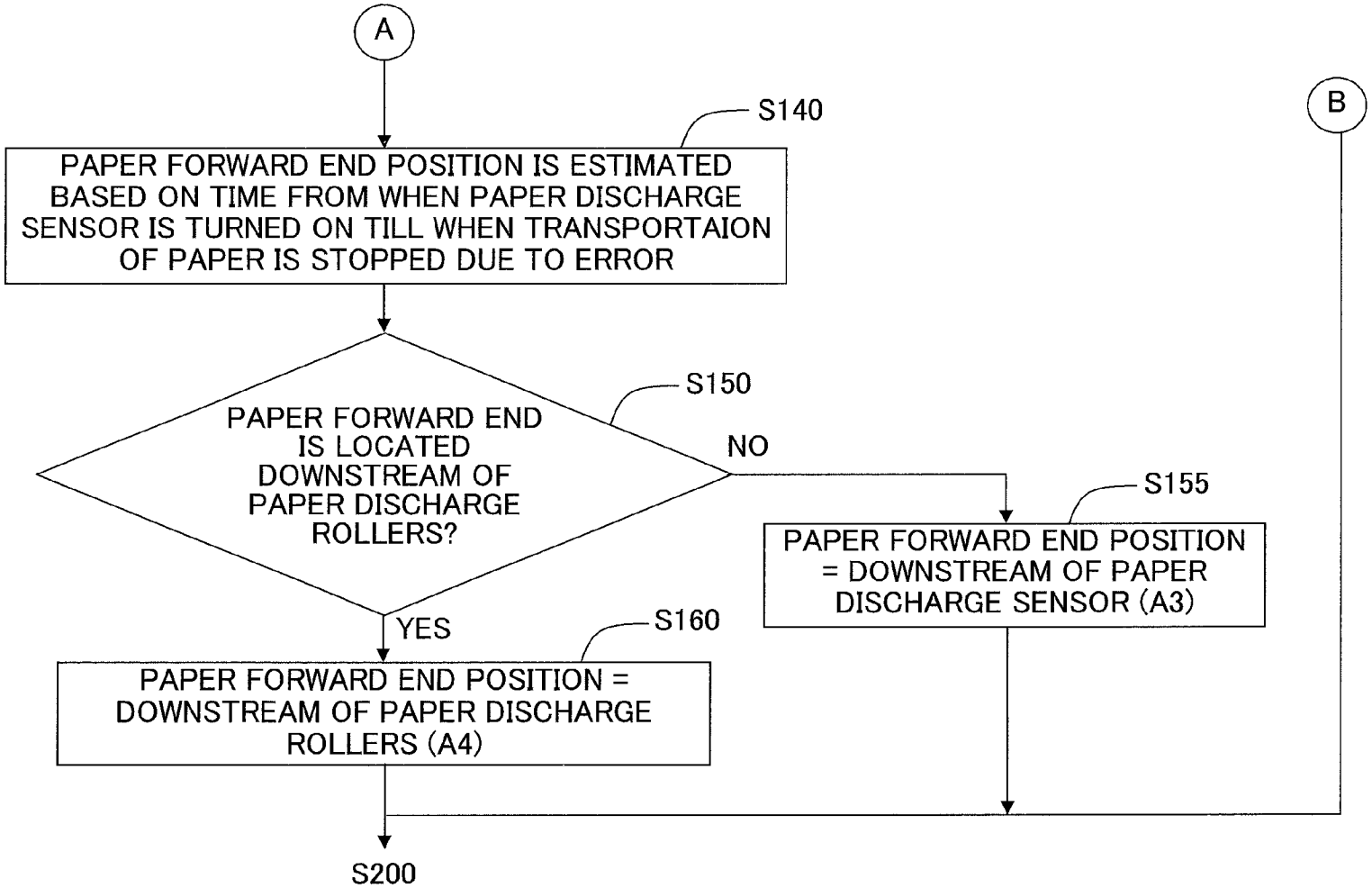

Next, the "routine for judging the paper forward end position" will be explained with reference to FIG. 4 and FIGS. 5A and 5B.

The CPU 40 estimates a paper forward end position TP based on a detection signal of the downstream sensor 11, at first, based on an elapsed time K1 elapsed after the downstream sensor 11 is turned on, till the transportation of the paper sheet 3 is stopped due to the transporting error (step S110). In particular, since transportation speed of the paper sheet 3, a distance from the downstream sensor 11 to the fixing unit 31, etc., are known, the paper forward end position TP is estimated by measuring the elapsed time K1, for example, by the timer 43.

Then, the CPU 40 judges whether or not the paper forward end 3A has entered into the fixing unit 31 based on an estimate result of the step S110 (step S120). When it is judged that the paper forward end 3A does not enter into the fixing unit 31 (step S120: NO), the CPU 40 sets the paper forward end position TP as the upstream of the fixing unit (A1: see FIG. 4) (step S125).

On the other hand, when it is judged that the paper forward end 3A has entered into the fixing unit 31 (step S120: YES), the CPU 40 judges whether or not the paper discharge sensor 32 has been turned on by the paper forward end 3A (step S130) based on a detection signal of the paper discharge sensor 32.

When it is judged that the paper discharge sensor 32 is not turned on by the paper forward end 3A (i.e. when it is judged that the paper forward end 3A is not detected by the paper discharge sensor 32) (step S130: NO), the CPU 40 sets the paper forward end position TP as the upstream of the paper discharge sensor (A2: see FIG. 4), which is an area located between the fixing unit 31 and the paper discharge sensor 32 (step S135). On the other hand, when it is judged that the paper discharge sensor 32 has been turned on by the paper forward end 3A (i.e. when it is judged that the paper discharge sensor 32 has detected the paper forward end 3A) (step S130: YES), the CPU 40 estimates the paper forward end position TP based on an elapsed time K2 elapsed after the paper discharge sensor 32 is turned on, till the transportation of the paper sheet 3 is stopped due to the error, as in the same manner as that of the step S110 (step S140).

Based on an estimate result at the step S140, it is judged whether or not the paper forward end 3A is located at the downstream side of the paper discharge rollers 33 in the paper transport direction (step S150). When it is judged that the paper forward end 3A is not located at the downstream side of the paper discharge rollers 33 in the paper transport direction, the CPU 40 sets the paper forward end position TP as the downstream of the paper discharge sensor (A3: see FIG. 4), which is an area located between the paper discharge sensor 32 and the paper discharge rollers 33 (step S155).

On the other hand, when it is judged that the paper forward end 3A is located at the downstream side of the paper discharge rollers 33 in the paper transport direction (step S150: YES), the CPU 40 sets the paper forward end position TP as the downstream of the discharge rollers 33 (A4: see FIG. 4) (step S160). The paper forward end position TP is determined as described above, and the process is shifted to the "routine for judging the paper backward end position" at the step S200 in FIG. 3A.

Figure 6A:
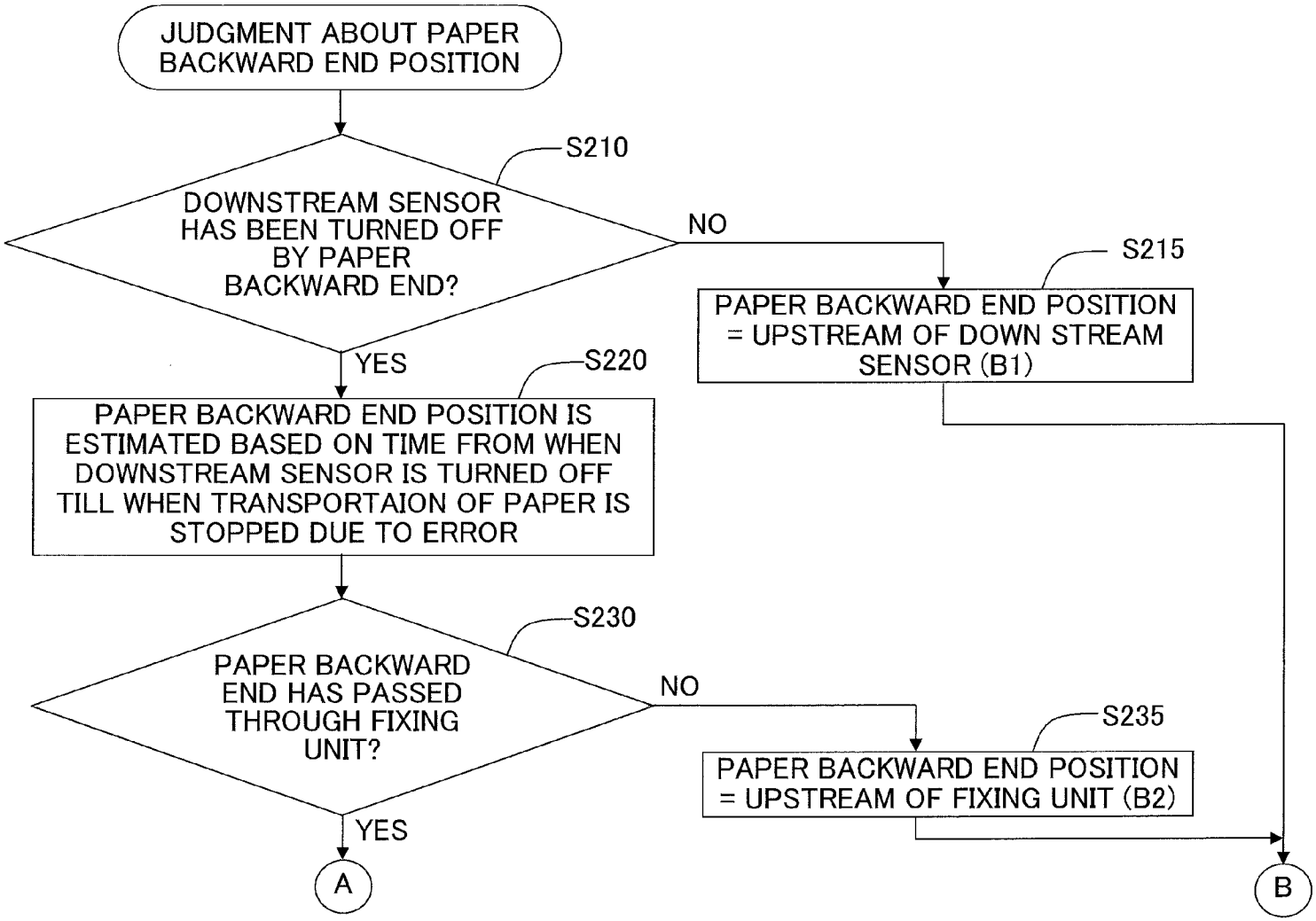
FIGS. 6A and 6B are a flowchart showing a routine for judging a paper backward end position.
Figure 6B:
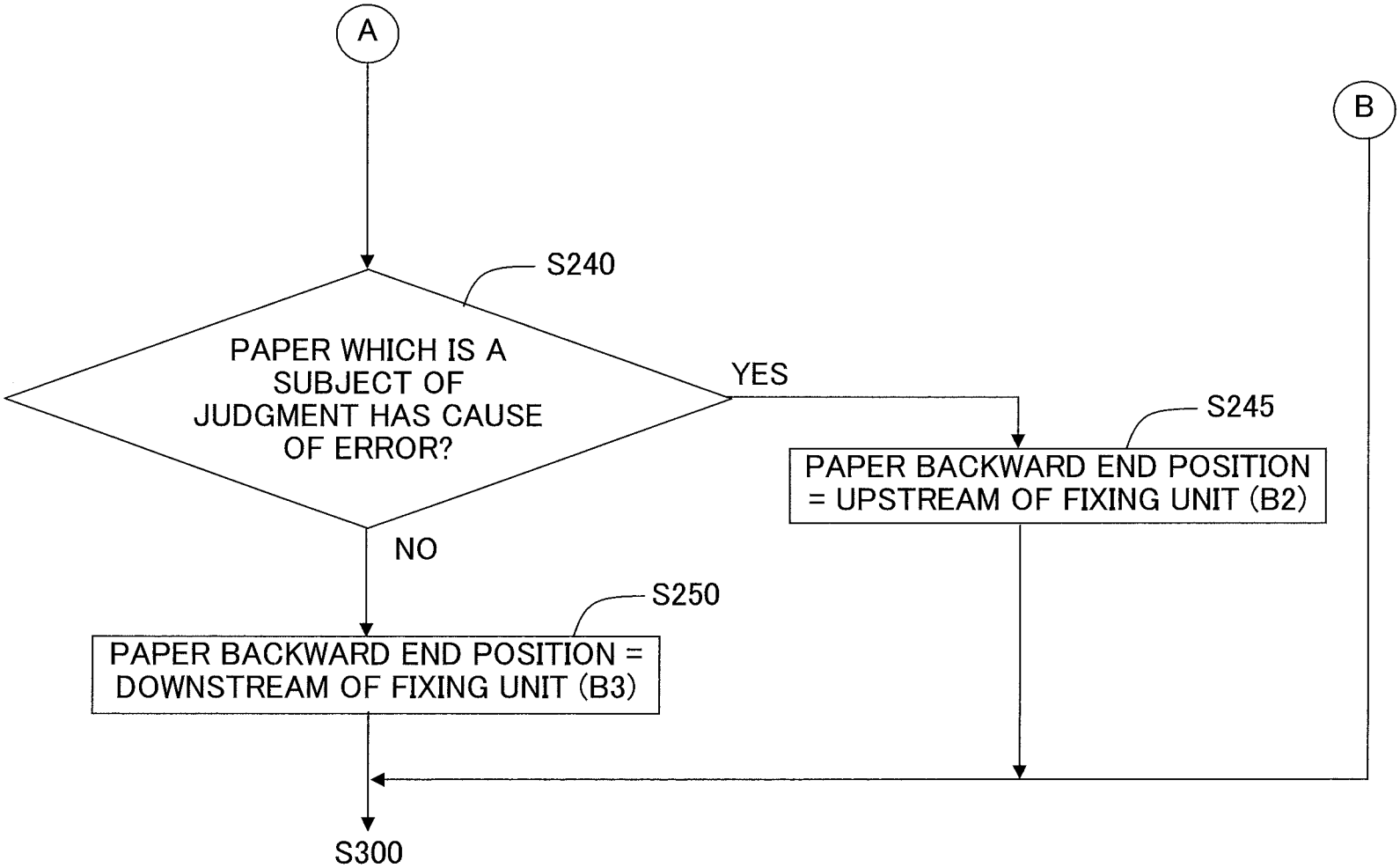
Figure 7:
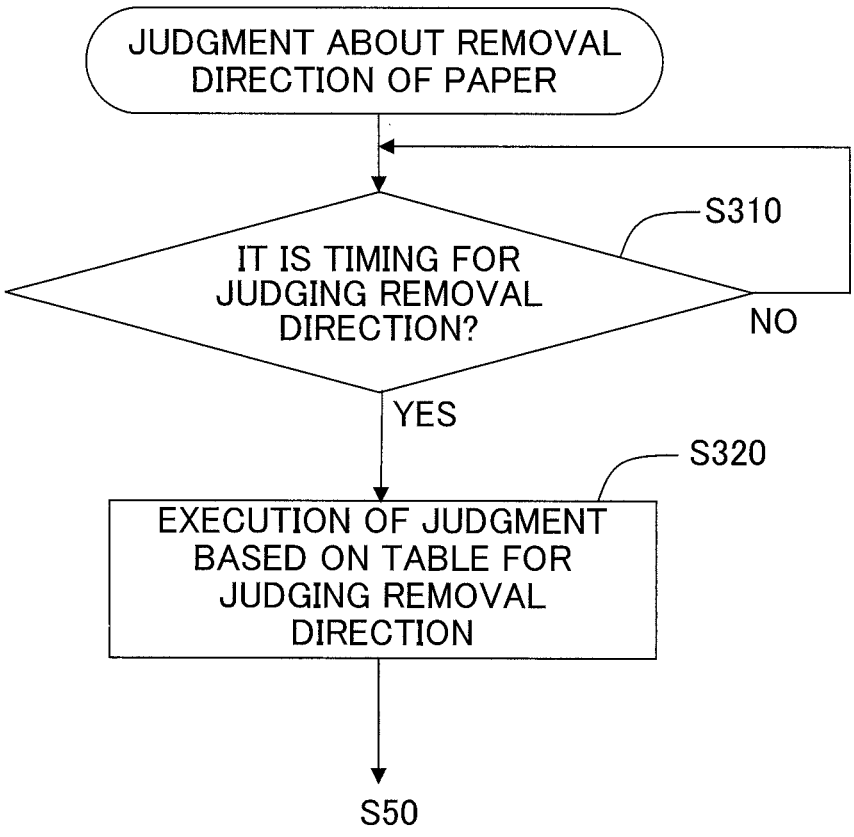
FIG. 7 is a flowchart showing a routine for judging a removal direction of the paper sheet.

Next, the "routine for judging the paper backward end position" will be explained with reference to FIG. 4 and FIGS. 6A and 6B.

The CPU 40 judges, at first, whether the downstream sensor 11 has been turned off by the paper backward end 3B (i.e. whether the downstream sensor 11 has detected the paper backward end 3B) (step S210). When it is judged that the downstream sensor 11 is not turned off (i.e. when it is judged that the paper backward end 3B is not detected by the downstream sensor 11) (step S210: NO), the CPU 40 sets a paper backward end position BP as the upstream of the downstream sensor 11 (B1: see FIG. 4) (step S215).

On the other hand, when it is judged that the downstream sensor 11 has been turned off by the paper backward end 3B (i.e. when it is judged that the downstream sensor 11 has detected the paper backward end 3B) (step S210: YES), the CPU 40 estimates the paper backward end position BP based on an elapsed time K3 elapsed after the downstream sensor 11 is turned off, till the transportation of the paper sheet 3 is stopped due to the error, as in the same manner as that of the step S110 (step S220).

Then, the CPU 40 judges whether the paper backward end 3B has passed through the fixing unit 31 based on an estimate result of the step S220 (step S230). When it is judged that the paper backward end 3B does not pass through the fixing unit 31 (step S230: NO), the CPU 40 sets the paper backward end position BP as the upstream of the fixing unit (B2: see FIG. 4) (step S235).

On the other hand, when it is judged that the paper backward end 3B has passed through the fixing unit 31 based on the elapsed time K3 (step S230: YES), the CPU 40 judges whether or not the paper sheet 3 which is a subject of the judgment has a cause of the error (paper jam) (step S240).

When it is judged that the paper sheet 3 which is the subject of the judgment has the cause of the error (step S240: YES), although it is judged that the paper backward end 3B has passed through the fixing unit 31 based on the elapsed time K3 at the step S230, the CPU 40 judges that the paper backward end 3B does not pass through the fixing unit 31 due to the error (paper jam), and sets the paper backward end position BP as the upstream of the fixing unit (B2) (step S245). On the other hand, when it is judged that the paper sheet 3 which is the subject of the judgment does not have the cause of the error (step S240: NO), the CPU 40 sets the paper backward end position BP as the downstream of the fixing unit (B3: see FIG. 4) (step S250). The paper backward end position BP is determined as described above, and the process is shifted to the "routine for judging the removal direction of the paper sheet" at the step S300 in FIG. 3A.

Next, the "routine for judging the removal direction of the paper sheet" will be explained with reference to FIG. 7 to FIG. 9D. Tables shown in FIG. 8 and FIGS. 9A to 9D are stored, for example, in the ROM 41. The CPU 40 refers to each of the tables every time when the CPU 40 executes each of the routines.

The CPU 40 judges whether or not a state of the paper sheet 3 corresponds to any of the timings (conditions) shown in FIG. 8 based on the paper forward end position TP and the paper backward end position BP which are determined by the "routine for judging the paper forward end position" and the "routine for judging the paper backward end position" respectively, the detection signals (sensor ON/OFF) of the downstream sensor 11 and the paper discharge sensor 32, and the detection signals (opening/closing of covers) of the upper cover sensor 48 and the rear cover sensor 49 (step S310).

When it is judged that the state of paper sheet 3 corresponds to any of the timings (conditions) (step S310: YES), the CPU 40 judges the removal direction of the paper sheet 3, for example, based on tables for judging the removal direction of the paper sheet shown in FIGS. 9A to 9D (step S320). Note that the tables for judging the removal direction of the paper sheet shown in FIGS. 9A to 9D show the removal (pull-out) directions of the paper sheet 3, each of which corresponds to one of the conditions in the condition (timing) table for judging the removal direction of the paper sheet shown in FIG. 8. In FIGS. 9A to 9D, in a case that the printer is not provided with the rear cover (downstream cover) 2B, it is judged that the downstream cover is closed. Further, in a case that the opening/closing of the downstream cover is undetectable, it is judged that the downstream cover is opened.

For example, when the paper forward end position TP is located at the upstream of the fixing unit (A1) and the paper backward end position BP is located at the upstream of the downstream sensor (B1), the judgment about the removal direction of the paper sheet is performed at the timing at which the downstream sensor 11 is turned off based on the timing table of FIG. 8. If the upper cover 2A and the rear cover 2B are opened when the downstream sensor 11 is turned off, the CPU 40 judges that the paper sheet 3 is removed (pulled) toward the upstream side of the fixing unit 31 in the paper transport direction based on the table of FIG. 9A.

Further, for example, when the paper forward end position TP is located at the downstream of the paper discharge sensor (A3) and the paper backward end position BP is located at the upstream of the fixing unit (B2), the judgment about the removal direction of the paper sheet is performed at the timing at which the paper discharge sensor 32 is turned off based on the timing table of FIG. 8. If the upper cover 2A is closed and the rear cover 2B is opened when the paper discharge sensor 32 is turned off, the CPU 40 judges that the paper sheet 3 is removed (pulled) toward the downstream side of the fixing unit 31 in the paper transport direction based on the table in FIG. 9C.

Figure 10A:
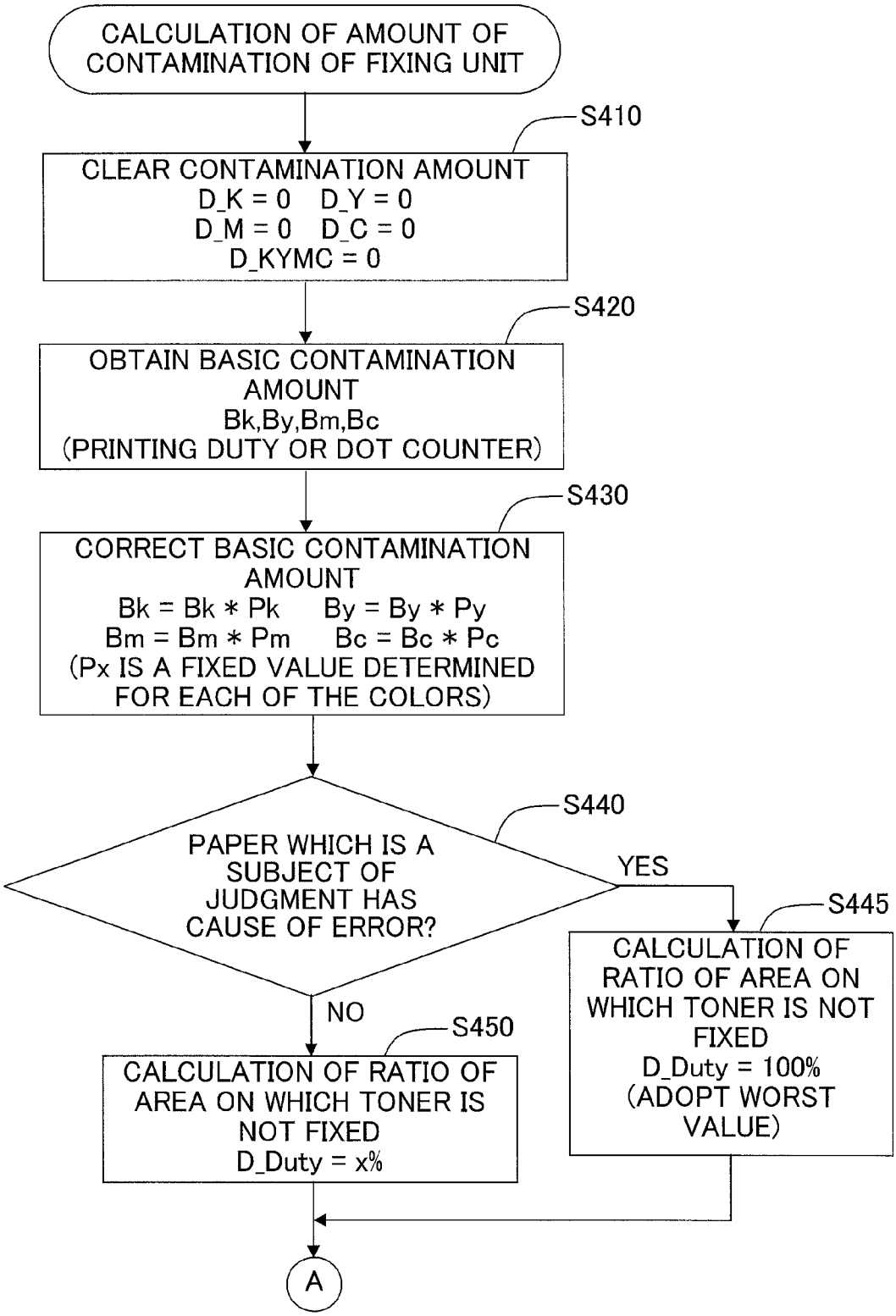
FIGS. 10A and 10B are a flowchart showing a routine for calculating an amount of contamination of the fixing unit.
Figure 10B:
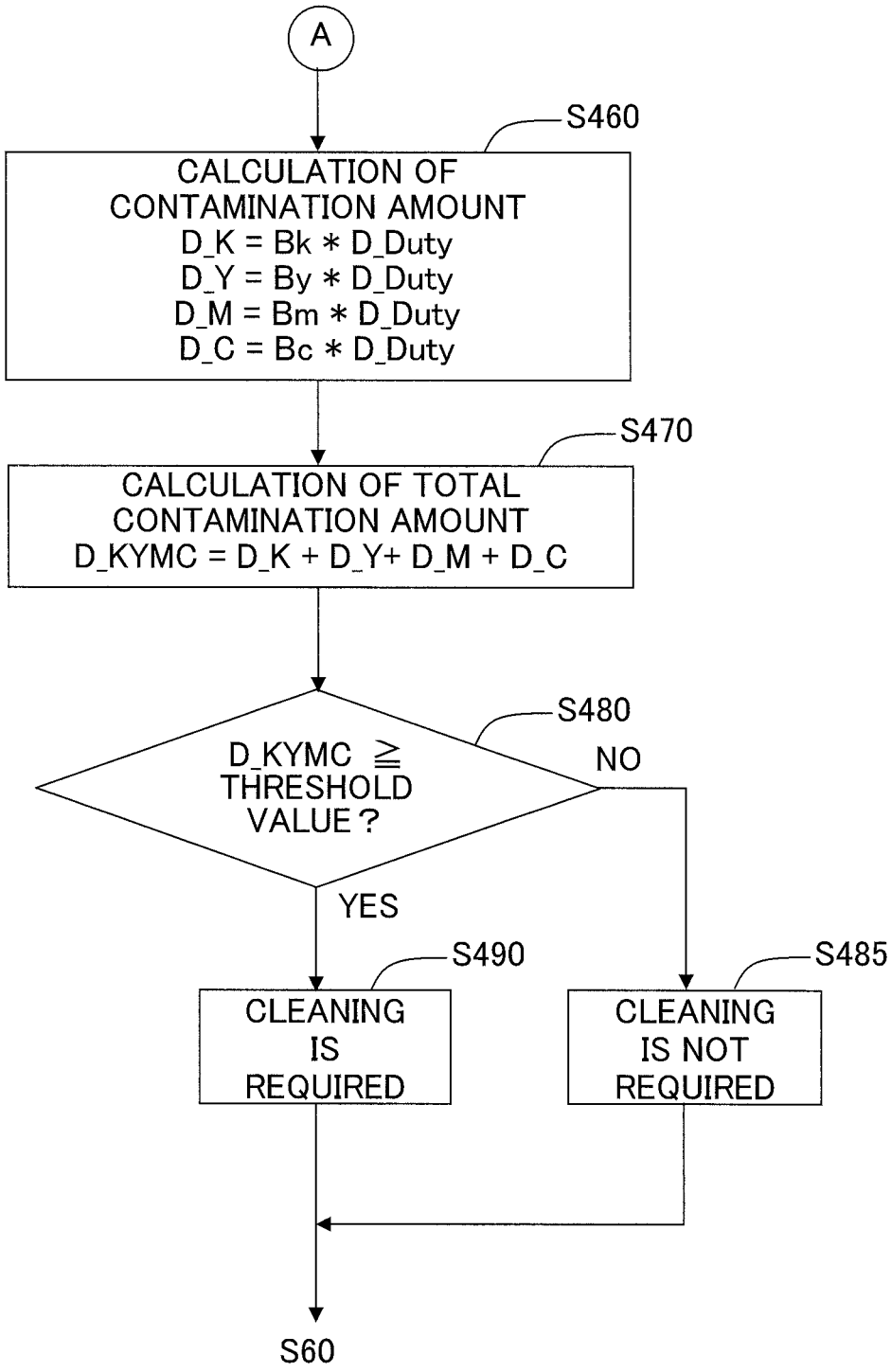
Figure 11:
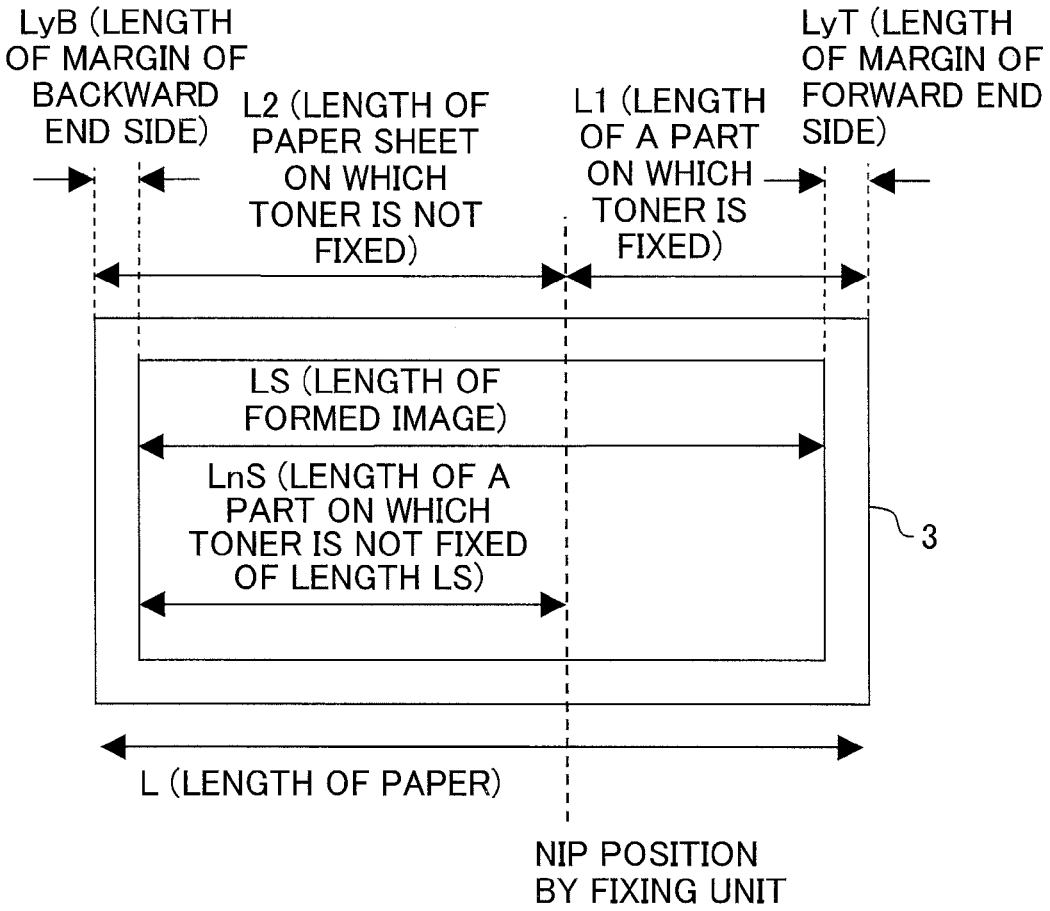
FIG. 11 is an illustrative view illustrating a length of each section of the paper sheet.

Next, the "routine for calculating the amount of contamination of the fixing unit" will be explained with reference to FIGS. 10A and 10B and FIG. 11.

At first, the CPU 40 zero-clears contamination amounts (D_K, D_Y, D_M, D_C) of respective colors and a total contamination amount (D_KYMC) (step S410). Then, the CPU 40 obtains basic contamination amounts (Bk, By, Bm, Bc) of respective colors (step S420).

Here, the basic contamination amount B is obtained, for example, from a printing duty or a dot counter. In particular, a value which linearly increases according to the printing duty or the dot counter is defined as the basic contamination amount B. For example, the value is set such that the value is increased by 100 points when the printing duty is increased by 1%, and the value is increased by 1 point when the dot counter counts 1 dot. Subsequently, the CPU 40 corrects the basic contamination amounts (Bk, By, Bm, Bc) depending on contamination amount correction values P which are fixed values and differ according to the respective colors (step S430). Then, the CPU 40 judges whether or not the paper sheet 3 which is the subject of the judgment has the cause of the error (paper jam) (step S440).

When it is judged that the paper sheet 3 which is the subject of the judgment has the cause of the error, the CPU 40 sets, for example, D_duty, which is a ratio of an area on which the toner is not fixed, as 100% which is the worst (step S445). On the other hand, when it is judged that the paper sheet 3 which is the subject of the judgment does not have the cause of the error, the CPU 40 calculates the D_duty in accordance with the following expression (1) (step S450). Here, in a case of length L which is a length of a paper sheet≥(length LS which is a length of a formed image+length LyT which is a length of a margin of a forward end side of the paper sheet), the D_duty is as follows.

$$D_\text{duty}(\%)=\text{length } LnS/\text{the length } LS \qquad \text{Expression 1}$$

Here, the length Lns is a length of a part on which the toner is not fixed of the length LS. Namely, the length LnS=the length LS−(length L1 which is a length of a part on which the toner is fixed of the length L−the length LyT) (see FIG. 11).

Further, the length L is a length of a long side of the paper sheet 3. The length LS is a length of an area, on which a toner image transferred to the paper sheet 3 is formed, in the long-side direction of the paper sheet. The length LyT is a length of an area of the paper forward end portion, on which the toner image is never formed, in the long-side direction of the paper sheet. The length LnS is a length of an area on which the toner is not fixed, of the area on which the toner image is formed, in the long-side direction of the paper sheet (see FIG. 11). Further, in FIG. 11, a length LyB, which is a length of a margin of a backward end side of the paper sheet, is a length of an area of the paper backward end portion, on which the toner image never formed, in the long-side direction of the paper sheet. The length L1, which is a length of a part on which the toner is fixed, ranges from the paper forward end 3A to a nip position by the fixing unit. A length L2, which is a length of a part on which the toner is not fixed, ranges from the paper backward end 3B to the nip position by the fixing unit.

In a case that the length LS is constant independently of the length L, a case in which the length L<(the length LS+the length LyT) may arise. In that case, the length LnS has the same length as the length L2 in the expression (1).

Subsequently, the CPU 40 calculates each of the contamination amounts (D_K, D_Y, D_M, D_C) by multiplying each basic contamination amount corrected at the step S430 by the D_duty (step S460). Then, the CPU 40 calculates the total contamination amount (D_KYMC) by adding each of the contamination amounts (step S470). When the calculated total contamination amount (D_KYMC) exceeds a predetermined threshold value (step S480: YES), the CPU 40 judges that the cleaning is required (step S490), and the process is returned to the step S60 in FIG. 3B. On the other hand, when the total contamination amount (D_KYMC) is less than the predetermined threshold value (corresponding to a predetermined amount) (step S480: NO), the CPU 40 judges that the cleaning is not required (step S485), and the process is returned to the step S60.

As described above, in this embodiment, the CPU 40 judges whether or not the paper sheet 3, the transportation of which is stopped, is passing through the fixing unit 31. When it is judged that the paper sheet 3 is passing through the fixing unit 31, the CPU 40 judges to which one of the upstream side and the downstream side of the fixing unit 31 in the paper transport direction the paper sheet 3 is removed. On the other hand, when it is judged that the paper sheet 3 is not passing through the fixing unit 31, the CPU 40 does not perform the judgment about the removal direction of the paper sheet and does not prompt the execution of the cleaning mode. This is because, only if the paper sheet 3 is passing through the fixing unit 31 when the transportation of the paper sheet is stopped, the fixing unit 31 is contaminated by removing the paper sheet 3. Thus, the cleaning for the fixing unit 31 is not executed. Accordingly, it is possible to suppress the waste of the time and the paper sheets which would be otherwise caused by the cleaning for the fixing unit 31.

When the upper cover sensor 48 and the rear cover sensor 49 detect that the upper cover 2*a* is opened and the rear cover 2B is opened, respectively, after the transportation of the paper sheet 3 is stopped, the CPU 40 judges to which one of the upstream side and the downstream side of the fixing unit 31 in the paper transport direction the paper sheet 3 is removed, based on the measurement time, which is measured by the timer 43, from when the paper sheet is detected by each of the downstream sensor 11 and the paper discharge sensor 32. It is possible to perform the judgment about the removal (pull-out) direction of the paper sheet 3 more accurately by judging, based on the measurement time by the timer 43, to which side the paper sheet 3 is removed more easily. Further, even when upper cover 2A and the rear cover 2B are both opened, it is possible to perform the judgment about the removal direction of the paper sheet 3 more accurately.

Even when it is judged that the paper sheet 3 is pulled toward the downstream side in the paper transport direction, if it is judged that an amount of developer which is not fixed (total contamination amount) D_KYMC is less than the predetermined amount, the CPU 40 cancels the warning relating to the error without prompting the execution of the cleaning mode. That is, even when the paper sheet 3 is removed toward the downstream side of the fixing unit 31 in the paper transport direction, if the fixing unit 31 is not contaminated to such an extent that the cleaning for the fixing unit 31 is required (for example, a case in which the total contamination amount D_KYMC is less than the predetermined amount and the developer has been fixed substantially, or a case in which the developer to be fixed is hardly transferred to the paper sheet 3), the CPU 40 does not recommend (prompt) the execution of the cleaning mode. Therefore, it is possible to suppress the waste of the time and the paper sheets which would be otherwise caused by the cleaning for the fixing unit 31.

The present teaching is not limited to the embodiment explained through the above descriptions and drawings and, for example, the following embodiments are also included in the technical scope of the present teaching.

Figure 12:
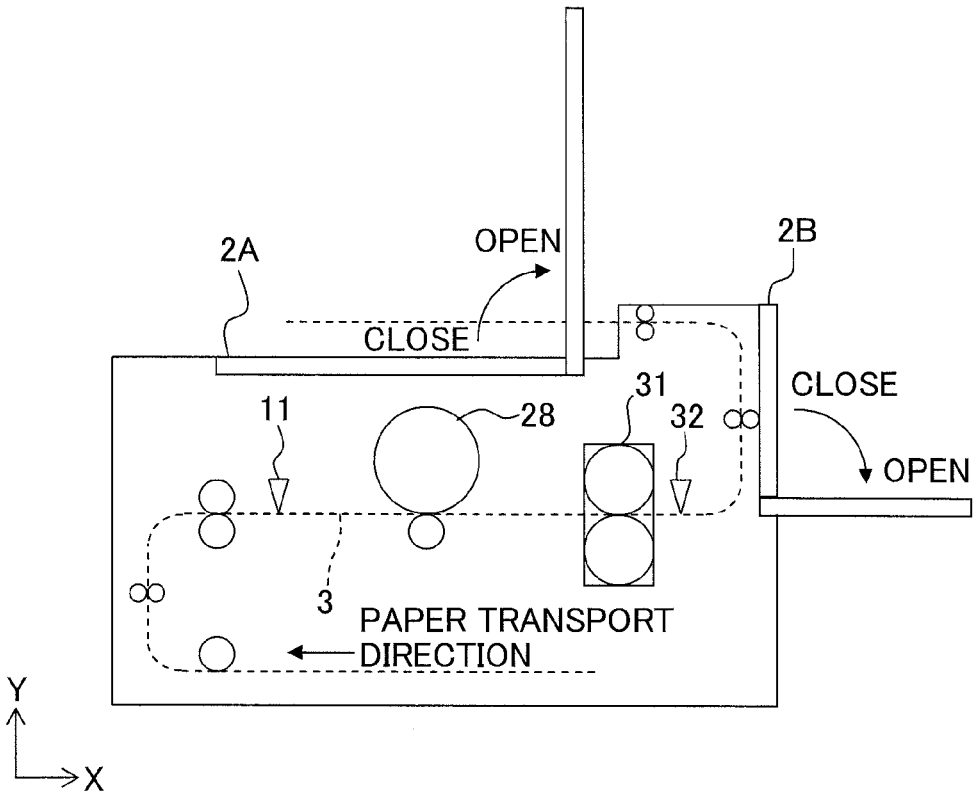
FIG. 12 is an illustrative view illustrating an arrangement of covers of an embodiment.
Figure 13:
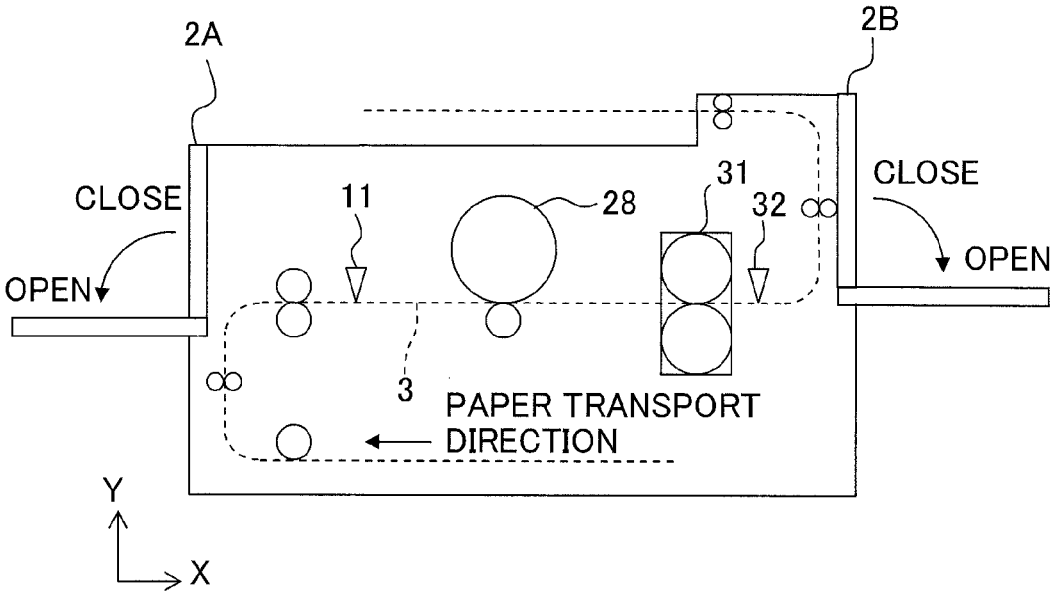
FIG. 13 is an illustrative view illustrating another arrangement of the covers.
Figure 14:
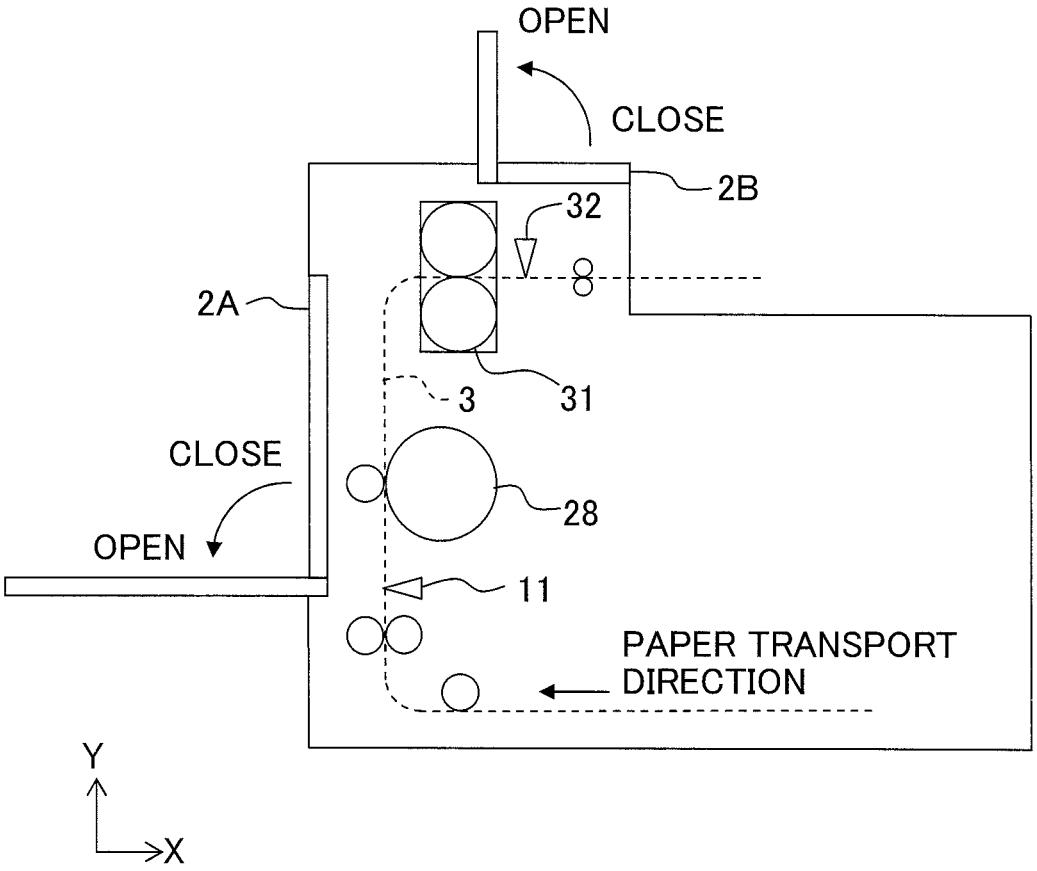
FIG. 14 is an illustrative view illustrating still another arrangement of the covers.

In the embodiment described above, the explanations were made with the example in which the present teaching is applied to the image forming apparatus which has a structure such that the upper cover 2A corresponds to the upstream cover and the rear cover 2B corresponds to the downstream cover, as shown in FIG. 1 and FIG. 12. However, the present teaching is not limited thereto. For example, as shown in FIG. 13, it is possible to apply the present teaching to an image forming apparatus having a structure such that a frontward cover 2A corresponds to the upstream cover and the rear cover 2B corresponds to the downstream cover, or as shown in FIG. 14, it is possible to apply the present teaching to an image forming apparatus having a structure such that a left side cover 2A corresponds to the upstream cover and an uppermost cover 2B corresponds to the downstream cover.

In the embodiment described above, the explanations were made with the example in which, when it is judged that the paper sheet 3 is removed toward the upstream side in the paper transport direction, the CPU 40 cancels the warning relating to the error without prompting the execution of the cleaning mode and whether the cleaning mode is executed or not is finally judged by the user. However, the present teaching is not limited thereto. That is, it is allowable that the CPU 40 does not execute the cleaning mode without leaving the final judgment to the user. In that case, the CPU 40 may operate automatically so as not to execute the cleaning mode, and thus there is no need the final selection by the user as to whether or not the cleaning mode is executed.

It is allowable that the CPU 40 judges that the paper sheet 3 is removed toward the upstream side of the fixing unit 31 in the paper transport direction, when the upper cover sensor 48 detects that the upper cover 2A is opened after the transportation of the paper sheet 3 is stopped. This is because in the case that the upper cover 2A is opened after the transportation of the paper sheet 3 is stopped, the paper sheet is likely to be removed toward the upstream side of the fixing unit 31 in the paper transport direction. Therefore, it is possible to judge that the paper sheet 3 is removed toward the upstream side with a simple configuration in which the upper cover sensor 48 detects that the upper cover 2A is opened.

The CPU 40 may judge that the paper sheet 3 is removed toward the upstream side of the fixing unit 31 in the paper transport direction, when the downstream sensor 11 detects a change from a paper presence state to a paper absence state in a state that the upper cover sensor 48 detects that the upper cover 2A is opened after the transportation of the paper sheet 3 is stopped. In that case, as compared with the case in which the judgment is performed based on only the detection by the upper cover sensor 48 in which the upper cover 2A is opened, it is possible to judge that the paper sheet 3 is removed toward the upstream side more accurately.

The CPU 40 may judge, irrespective of opening/closing of the upper cover 2A etc., that the paper sheet 3 is removed toward the upstream side of the fixing unit 31 in the paper transport direction, when the downstream sensor 11 detects the change from the paper presence state to the paper absence state, in a case that the transportation of the paper sheet 3 is stopped and after the paper discharge sensor 32 detects the change from the paper presence state to the paper absence state. In that case, it is possible to judge the removal direction of the paper sheet 3 suitably by using the two sensors.

It is allowable that the CPU (the judgment section, the control section) 40 judges to which one of the upstream side and the downstream side in the paper transport direction the paper sheet 3 is pulled, after the transportation of the paper sheet on which the image has been formed is stopped due to the error, without judging whether or not the paper sheet 3 is passing through the fixing unit 31 (see the step S40 in FIG. 3A); and the CPU 40 cancels the warning relating to the error without prompting the execution of the cleaning mode when it is judged that the paper sheet 3 is removed toward the upstream side in the paper transport direction. Also in this case, it is possible to omit the cleaning for the fixing section and to suppress the waste of the time and the paper sheets which would be otherwise caused by the cleaning for the fixing section. The reason thereof is considered that the developer which is not fixed is not likely to adhere to the fixing unit 31, when the paper sheet 3 is normally removed toward the upstream side in the paper transport direction, in view of an arrangement configuration of the fixing unit 31 and the upstream cover 2A for accessing the fixing section from the upstream side in the paper transport direction, as shown in FIG. 1.

It is allowable that the printer 1 further includes, as a mechanism for judging the removal direction of the paper sheet 3, a rotation direction sensor 34 (an example of a rotation detecting section; see FIG. 1 and FIG. 2) which detects, for example, a rotation direction of the pressurizing roller 31B of the fixing unit (fixing section) 31 after the transportation of the paper sheet 3 is stopped; and that the CPU (the judgment section) judges to which one of the upstream side and the downstream side of the fixing section in the paper transport direction the paper sheet 3 is removed, based on the rotation direction of the pressurizing roller (fixing section) 31B which is detected by the rotation direction sensor 34.

When the removal direction of the paper sheet 3 is judged based on the rotation direction of the pressurizing roller 31B, since the rotation direction of the fixing unit (pressurizing roller) 31 varies according to the removal direction of the paper sheet 3, the removal direction of the paper sheet 3 can be judged suitably by detecting the rotation direction of the fixing unit 31. When detecting the rotation direction of the fixing unit 31, a well-known rotational axis sensor etc. may be used as the rotation direction sensor 34.

In another configuration in which the CPU (judgment section) 40 judges the removal direction of the paper sheet 3, the CPU (judgment section) 40 may judge that the paper sheet 3 is removed toward the downstream side of the fixing unit 31 in the paper transport direction, in a case that the measurement time, which is measured by the timer 43, from when the paper sheet 3 is detected by the downstream sensor (paper detecting section) 11 till when the transportation of the paper sheet 3 is stopped, is not less than a first predetermined time. In that case, it is possible to suitably judge that the paper sheet 3 is removed toward the downstream side of the fixing unit 31 in the paper transport direction by setting the first predetermined time as, for example, a time at which a substantial portion of the paper sheet 3 passes through the fixing unit 31. This is because the substantial portion of the paper sheet 3 has passed through the fixing unit 31, and thus the paper sheet 3 is very likely to be removed toward the downstream side of the fixing unit 31 in the paper transport direction.

It is allowable that the CPU (judgment section) 40 judges that the paper sheet 3 is removed toward the upstream side of the fixing unit 31 in the paper transport direction, in a case that the measurement time, by the timer 43, measured from when the paper sheet 3 is detected by the downstream sensor 11 till when the transportation of the paper sheet 3 is stopped, is not more than a second predetermined time, which is shorter than the first predetermined time. In that case, it is possible to suitably judge that the paper sheet 3 is removed toward the upstream side of the fixing unit 31 in the paper transport direction by setting the second predetermined time as, for example, a time at which the substantial portion of the paper sheet 3 does not pass through the fixing unit 31. This is because the substantial portion of the paper sheet 3 does not pass through the fixing unit 31, and thus the paper sheet 3 is very likely to be removed toward the upstream side of the fixing unit 31 in the paper transport direction.

What is claimed is:

1. An image forming apparatus which forms an image on a paper sheet, comprising:

an image forming section which forms the image on the paper sheet by using a developer;

a fixing section which includes a rotational axis and rotates around the rotational axis to fix the image formed on the paper sheet to the paper sheet;

a transport mechanism which transports the paper sheet on a paper transport route in a predetermined transport direction;

a transport stop detecting section which detects a transport stop of the paper sheet;

a judgment section which judges to which one of an upstream side and a downstream side of the fixing section in the transport direction the paper sheet is removed after the transport stop is detected by the transport stop detecting section; and a control section which controls the transport mechanism to execute a cleaning mode for cleaning the fixing section, and which determines whether or not the cleaning mode is to be executed based on a judgment result of the judgment section;

a reporting section which reports the transport stop to a user in a case that the transport stop is detected by the transport stop detecting section, wherein after the transport stop is detected by the transport stop detecting section, in a case that the judgment section judges that the paper sheet is removed toward the upstream side of the fixing section in the transport direction, the control section determines that the cleaning mode is not to be executed and controls the reporting section to cancel a report relating to the transport stop by controlling the reporting section.

2. The image forming apparatus according to claim 1, further comprising an upstream cover which is provided on the upstream side of the fixing section in the transport direction, wherein the fixing section and a part of the paper transport route on the upstream side of the fixing section in the transport direction are accessible for the user by opening the upstream cover, and the judgment section judges to which one of the upstream side and the downstream side of the fixing section in the transport direction the paper sheet is removed based on a rotation direction of the fixing section or an opening and closing of the upstream cover after a transportation of the paper sheet is stopped.

3. The image forming apparatus according to claim 2, further comprising an upstream cover detecting section which detects the opening and closing of the upstream cover, wherein in a case that the upstream cover detecting section detects that the upstream cover is opened after the transportation of the paper sheet is stopped, the judgment section judges that the paper sheet is removed toward the upstream side of the fixing section in the transport direction.

4. The image forming apparatus according to claim 2, further comprising a rotation detecting section which detects the rotation direction of the fixing section after the transportation of the paper sheet is stopped, wherein the judgment section judges to which one of the upstream side and the downstream side of the fixing section in the transport direction the paper sheet is removed based on the rotation direction of the fixing section detected by the rotation detecting section.

5. The image forming apparatus according to claim 2, further comprising:

an upstream cover detecting section which detects the opening and closing of the upstream cover; and a paper detecting section which detects presence or absence of the paper sheet transported by the transport mechanism, wherein in a state that the upstream cover detecting section detects that the upstream cover is opened after the transportation of the paper sheet is stopped, in a case that a detecting result detected by the paper detecting section changes from presence to absence, the judgment section judges that the paper sheet is removed toward the upstream side of the fixing section in the transport direction.

6. The image forming apparatus according to claim 5, further comprising a timer which starts a measurement of time at a timing at which a detection result of the paper detecting section changes, wherein the judgment section judges whether or not the paper sheet, the transportation of which is stopped, is passing through the fixing section based on the detection result of the paper detecting section and a measurement time by the timer; and judges to which one of the upstream side and the downstream side of the fixing section in the transport direction the paper sheet is removed in a case that the judgment section judges that the paper sheet is passing through the fixing section, and wherein in a case that the judgment section judges that the paper sheet is not passing through the fixing section, the control section determines that the cleaning mode is not to be executed.

7. The image forming apparatus according to claim 6, wherein the paper detecting section includes a first paper detecting section which is arranged at the upstream side of the fixing section in the transport direction and detects a forward end and a backward end of the paper sheet transported by the transport mechanism; and the judgment section judges whether or not the paper sheet is passing through the fixing section based on an elapsed time elapsed after the first paper detecting section detects the forward end or the backward end of the paper sheet.

8. The image forming apparatus according to claim 6, wherein the paper detecting section includes a paper discharge sensor which is arranged at the downstream side of the fixing section in the transport direction and detects a forward end and a backward end of the paper sheet transported by the transport mechanism; and in a case that the paper discharge sensor detects the backward end of the paper sheet, the judgment section judges that the paper sheet is not passing through the fixing section.

9. The image forming apparatus according to claim 6, wherein in a case that the judgment section judges that the paper sheet is removed toward the downstream side of the fixing section in the transport direction, the control section determines that the cleaning mode is to be executed and controls the reporting section to report that the cleaning mode is to be executed to the user.

10. The image forming apparatus according to claim 9, further comprising an operation section through which the user inputs a selection as to whether or not the cleaning mode is executed to the image forming apparatus.

11. The image forming apparatus according to claim 3, further comprising:

a first paper detecting section which is arranged at the upstream side of the fixing section in the transport direction and detects presence or absence of the paper sheet transported on the upstream side of the fixing section in the predetermined transport direction; and a second paper detecting section which is arranged at the downstream side of the fixing section in the transport direction and detects presence or absence of the paper sheet transported on the downstream side of the fixing section in the transport direction, wherein after the transportation of the paper sheet is stopped, in a case that a detecting result detected by the second paper detecting section changes from presence to absence and then a detecting result detected by the first paper detecting section changes from presence to absence, the judgment section judges that the paper sheet is removed toward the upstream side of the fixing section in the transport direction.

12. The image forming apparatus according to claim 2, further comprising:

a paper detecting section which detects a presence or absence of the paper sheet transported by the transport mechanism; and a timer which starts a measurement of time when the paper sheet is detected by the paper detecting section, wherein the judgment section judges to which one of the upstream side and the downstream side of the fixing section in the transport direction the paper sheet is removed based on a measurement time, of the timer, from a point of time at which the timer started the measurement to a point of time at which the transportation of the paper sheet is stopped.

13. The image forming apparatus according to claim 12, further comprising:

an upstream cover detecting section which detects the opening and closing of the upstream cover;

a downstream cover which is provided on the downstream side of the fixing section in the transport direction; and a downstream cover detecting section which detects the opening and closing of the downstream cover;

wherein the fixing section and another part of the paper transport route on the downstream side of the fixing section in the transport direction are accessible for the user by opening the downstream cover, and after the transportation of the paper sheet is stopped, in a case that the upstream cover detecting section and the downstream cover detecting section detect that the upstream cover is opened and the downstream cover is opened, respectively, the judgment section judges to which one of the upstream side and the downstream side of the fixing section in the transport direction the paper sheet is removed, based on the measurement time.

14. The image forming apparatus according to claim 12, wherein in a case that the measurement time is not less than a first predetermined time, the judgment section judges that the paper sheet is removed toward the downstream side of the fixing section in the transport direction.

15. The image forming apparatus according to claim 14, wherein in a case that the measurement time is not more than a second predetermined time, which is shorter than the first predetermined time, the judgment section judges that the paper sheet is removed toward the upstream side of the fixing section in the transport direction.

16. The image forming apparatus according to claim 1, further comprising a calculating section which calculates an amount of the developer which is not fixed, wherein even in a case that the judgment section judges that the paper sheet is removed toward the downstream side of the fixing section in the transport direction, if the amount of the developer which is not fixed is less than a predetermined amount, the control section determines that the cleaning mode is not to be executed and controls the reporting section to cancel the report relating to the transport stop.

17. The image forming apparatus according to claim 1, wherein the judgment section judges to which one of the upstream side and the downstream side of the fixing section in the transport direction the paper sheet is removed, even in a case that a transportation of the paper sheet is stopped due to a cause other than a paper jam at the fixing section.

18. The image forming apparatus according to claim 1, wherein the control sections controls the transport mechanism to clean the fixing section by passing the paper sheet through the fixing section during the cleaning mode.

19. The image forming apparatus according to claim 1, wherein in a case that the judgment section judges that the paper sheet is removed toward the upstream side of the fixing section in the transport direction, the control section controls the transport mechanism so as not to execute the cleaning mode.

20. The image forming apparatus according to claim 1, wherein the transport stop detecting section includes a paper detecting section which detects presence or absence of the paper sheet transported by the transport mechanism and a timer which starts a measurement of time at a timing at which a detection result of the paper detecting section changes, wherein the transport stop detecting section detects the transport stop of the paper sheet as a paper jam in a case that the detecting result detected by the paper detecting section does not change from presence to absence or from absence to presence for a predetermined time period since the timer has started the measurement.

21. The image forming apparatus according to claim 1, wherein the transport stop detecting section detects the transport stop of the paper sheet in a case that an indirect error, which does not directly cause the transport stop of the paper sheet but by which the transportation of the paper sheet can not be continued, occurs to the image forming apparatus.

* * * * *